US012031804B1

(12) United States Patent
Cho

(10) Patent No.: US 12,031,804 B1
(45) Date of Patent: Jul. 9, 2024

(54) MULTIPURPOSE LIVE BULLET TESTING RECEIVER AND BULLET TRAP

(71) Applicant: Benson Yuk Cho, San Francisco, CA (US)

(72) Inventor: Benson Yuk Cho, San Francisco, CA (US)

( * ) Notice: Subject to any disclaimer, the term of this patent is extended or adjusted under 35 U.S.C. 154(b) by 0 days.

(21) Appl. No.: 18/195,271

(22) Filed: May 9, 2023

(51) Int. Cl.
*F42B 35/00* (2006.01)

(52) U.S. Cl.
CPC ..... *F42B 35/00* (2013.01)

(58) Field of Classification Search
CPC ..... F42B 35/00
See application file for complete search history.

(56) References Cited

U.S. PATENT DOCUMENTS 523,510 A * 7/1894 Brunswig ..... G01L 5/14 73/167
941,642 A * 11/1909 Maxim ..... F41J 13/00 273/410
5,988,647 A * 11/1999 Porter ..... F41J 13/00 89/36.02
6,016,735 A * 1/2000 Langner ..... F41J 13/00 89/917
7,163,205 B1 * 1/2007 Kecskes ..... F41A 31/00 273/410
10,030,945 B1 * 7/2018 Mol ..... F41J 13/00
10,371,489 B2 * 8/2019 Wall ..... F41J 13/00
2002/0139182 A1 * 10/2002 Duke ..... F42B 35/00 73/167
2010/0269581 A1 * 10/2010 Giurintano ..... F41J 1/00 73/167
2012/0181752 A1 * 7/2012 Bavaro ..... F41J 13/00 273/410
2014/0346734 A1 * 11/2014 John ..... F41J 13/00 273/410
2015/0084284 A1 * 3/2015 Cibrian Vidrio ..... F41J 13/00 273/410
2016/0003584 A1 * 1/2016 Durynski ..... F41J 13/02 273/410
2017/0328688 A1 * 11/2017 Bateman ..... B23K 11/0053

FOREIGN PATENT DOCUMENTS

CN 104267204 A * 1/2015
CN 107246826 A * 10/2017

* cited by examiner

*Primary Examiner* — Natalie Huls
(74) *Attorney, Agent, or Firm* — Workman Nydegger

(57) ABSTRACT

An apparatus is structured to receive and contain a bullet. This apparatus also aids in determining a penetrative effect of the bullet relative to a material disposed in the apparatus. The apparatus includes an elongated central core comprising an internal cavity. This internal cavity facilitates ballistic penetrative testing on the material. The apparatus includes a removable lid coupled to the elongated central core. When the removable lid is coupled to the elongated central core, the two components cause the internal cavity to become a sealed internal cavity, except for one directed entry section through which the moving bullet can enter the internal cavity. The apparatus includes a funnel-like member having a wider opening and narrower opening. The funnel-like member is coupled to the elongated central core. The narrower opening provides the directed entry section. Additionally, the funnel-like member is structured to guide the bullet into the sealed internal cavity.

20 Claims, 28 Drawing Sheets

MULTIPURPOSE LIVE BULLET TESTING RECEIVER AND BULLET TRAP

BACKGROUND

The term "bulletproofing" refers to the general process of making or fabricating a material that is capable of withstanding the effects of a bullet and that can potentially even stop the bullet, even when it is fired at a high velocity. Some of the common types of bulletproof materials include, but certainly are not limited to, steel, Kevlar, ceramic, some fiberglass, some wood, and various other materials.

To test the durability of a material, it is often necessary to fire a bullet at that material. After the bullet is fired, the material can be analyzed to determine how well it held up to the impact of the bullet. It is desirable to provide a safe environment in which to test materials with regard to their ability to be bulletproof.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Embodiments disclosed herein relate to a type of apparatus structured to receive and contain a bullet or projectile in motion. This apparatus is further structured to aid in determining a penetrative effect of the projectile relative to at least one material disposed within an internal confines of the apparatus.

Some embodiments include an elongated central core comprising an internal cavity structured to house the material. This internal cavity is also structured to facilitate ballistic penetrative testing on the material. The embodiments further include a removable lid structured to couple to the elongated central core. When the removable lid is coupled to the elongated central core, a combination of the elongated central core and the removable lid cause the internal cavity to become a sealed internal cavity save for one directed entry section of the sealed internal cavity through which the bullet in motion can enter the internal cavity. The embodiments also include a funnel-like member having a wider opening and a narrower opening. The funnel-like member is coupled to the elongated central core. The narrower opening provides the directed entry section into the sealed internal cavity. Additionally, the funnel-like member, based on its shape, is structured to guide the bullet into the sealed internal cavity.

Some embodiments structure the elongated central core to be shaped as a rectangular prism. Some embodiments structure the removable lid to include a first handle and a second handle.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Figure 1:
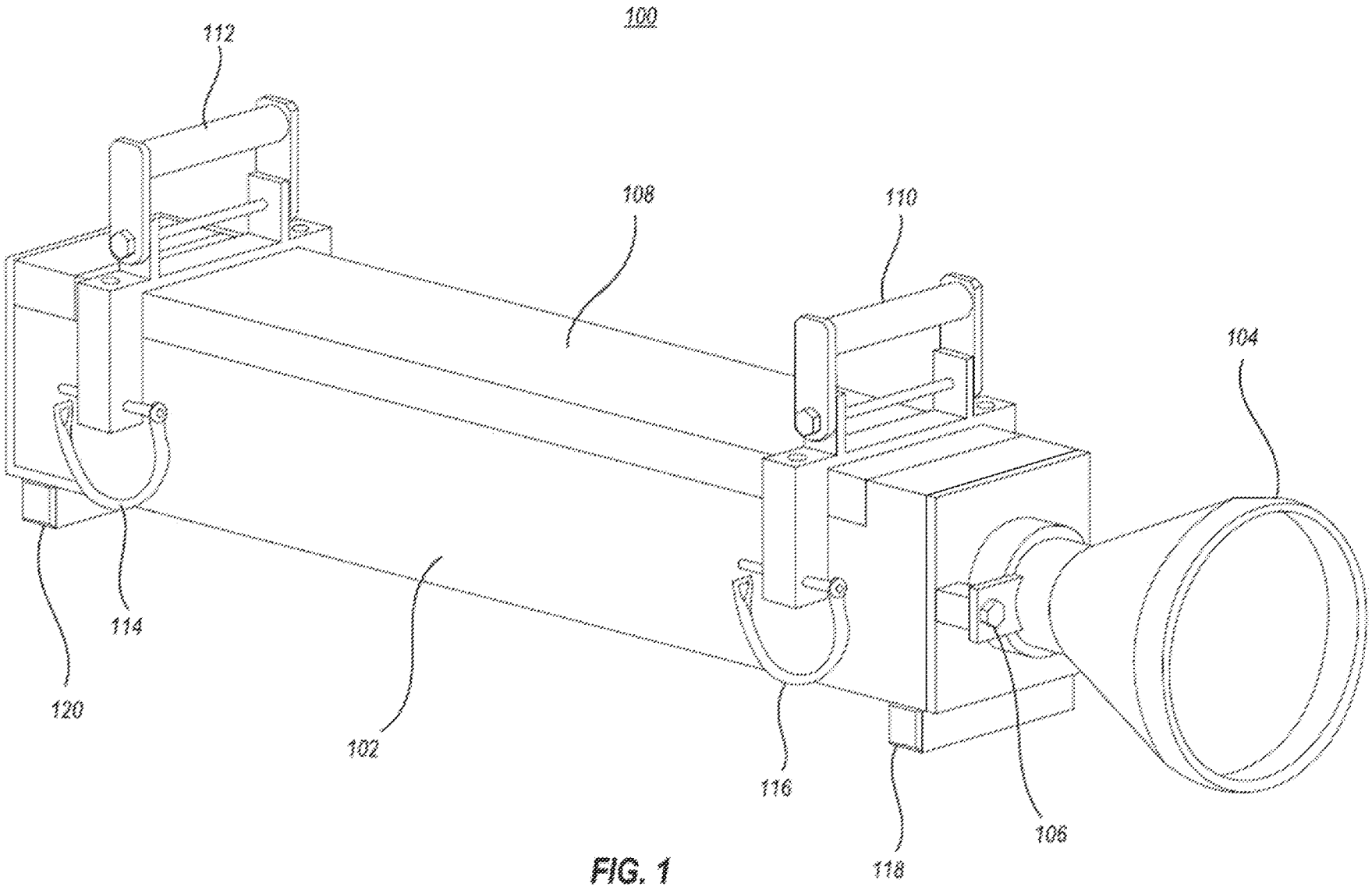
FIG. 1 illustrates an angled perspective view of the disclosed apparatus.

The disclosed multipurpose live bullet receiver is a simple, mechanically constructed piece of equipment. The receiver is fully exposed, or at least can be fully exposed, to allow for easy inspection of materials disposed within the receiver. The receiver also beneficially includes a quick to attach/detach lid, thereby facilitating ease of operation and multiple uses. The receiver also has one, two, or potentially more functional comfort grab handles. The receiver can be used for a variety of reasons, including testing gunpowder formula, testing the shape of a bullet tip, and testing a material to see how well that material can handle the impact from a bullet. Other functions can be used, depending on the user.

The receiver unit includes a wooden or plywood component. This component creates friction and reduces the energy of the bullet. Multiple layers of wood or plywood can be used. A different material can also optionally be used, depending on the user or the use case scenario.

The function of the disclosed "bump shield" is to reduce the force of the bullet. It also stops the bullet.

The springs' functions are to reduce the strike force of the bullet. When springs compress to shorter than the foam's thickness, the foam can also have the same function as the springs. The foam also acts as a holder for the springs.

The disclosed funnel can guide the bullet into the receiver. The funnel can be separated from the main body and can be changed to different sizes and angles. The funnel's front area is larger than the main body so the funnel can protect the receiver from being struck by the bullet. The funnel's front edge and bumper holder shank tip are rounded. Both can change the bullet's direction and prevent the bullet from reflecting 180 degrees, thereby avoiding a scenario where the bullet might hit the shooter.

The disclosed carboard target has four foldable handles and can be inserted into the receiver's funnel. If the target does not have a bullet hole, then a bullet did not enter the receiver and no internal inspection is needed. The presence of a bullet hole means the bullet has entered the receiver and inspection is warranted. When there is a hole in the cardboard, masking tape can be used to patch the bullet hole and the target can be used again. This means the cardboard hole will provide an indication to the user as to whether or not the bullet is inside the receiver.

The bumper assembly can be removable and be put together in an easy manner. The assembly can be inserted into the main body's dead-end side. Doing so will make the inspection convenient and easy to clean up. When operating or inspecting, it is recommended to use the hitch pin to quickly connect and disconnect so as to speed up the process.

When the receiver is moved, it is recommended to use the socket head cap bolts. These bolts can be snugly tightened. All of the dimensions, funnel angles, and shapes can be modified.

Accordingly, embodiments disclosed herein relate to an apparatus structured to receive and contain a bullet or any type of projectile. This apparatus also aids in determining a penetrative effect of the bullet relative to a material disposed in the apparatus. Other uses, as described below, can also be implemented.

Some embodiments of the apparatus include an elongated central core comprising an internal cavity. This internal cavity facilitates ballistic penetrative testing on the material. The apparatus includes a removable lid that couples to the elongated central core. When the removable lid is coupled to the elongated central core, the two components cause the internal cavity to become a "sealed" internal cavity, except for one directed entry section through which the moving bullet can enter the internal cavity. The apparatus includes a funnel-like member having a wider opening and narrower opening. The funnel-like member is coupled to the elongated central core. The narrower opening provides the directed entry section. Additionally, the funnel-like member is structured to guide the bullet into the sealed internal cavity. An absorption unit can be disposed inside of the internal cavity to help absorb the impact of the bullet. A material that is being tested is also disposed inside of the cavity.

Some embodiments of the apparatus structure the elongated central core to be shaped as a rectangular prism. The removable lid can also include a first handle and a second handle. The various corners of the apparatus can be smoothed, rounded, or perhaps even sharp. The apparatus further includes an absorption unit, which can be removable from the main body end plate to become a dead end. The absorption unit (aka a "bumper assembly") is beneficially removable, which increases flexibility and improves aesthetics. The absorption unit can be put together and then inserted into the main body's dead end side (i.e. the back end). Doing so allows inspection to be easy and allows cleaning of the apparatus to be streamlined.

The disclosed multipurpose live bullet testing receiver (i.e. the apparatus) provides a simple, mechanically constructed piece of equipment designed to facilitate ballistic impact testing. The apparatus is easily deconstructed and can be fully exposed for easy inspection and cleaning. The apparatus includes a number of quick disconnect couplers or features to enable the easy opening. The apparatus also includes a number of easy to use and ergonomic grab handles. The uses of the disclosed apparatus include, but certainly are not limited to, testing of gunpowder formulas, testing the shape of a bullet tip, and testing materials to see how well they can handle a bullet.

The disclosed embodiments provide numerous benefits, advantages, and real-world improvements to the technical field of ballistic analysis of materials. In particular, the embodiments provide a unit that can receive and contain a bullet in motion and can allow that bullet to strike, within the apparatus's internal cavity, a material. Because of how the apparatus is structured, that bullet will then continue to be contained within the apparatus until its kinetic energy has dissipated, such as via the use of the absorption unit. The apparatus can then be easily opened to reveal the material. The material can be examined to determine how it faired with regard to being struck by the bullet. Because of the structure of the apparatus, the embodiments significantly improve the safety and workability of technicians tasked with analyzing the impact of a bullet on a material. Accordingly, these and many other benefits will now be described throughout the remaining portions of this disclosure.

It should be noted that this disclosure includes various different example values for lengths, widths, heights, and thicknesses. It should be noted how these values are example values, and other values can also be used. Indeed, the size of the apparatus can be modified to accommodate any size that is desirable.

Attention will now be directed to FIG. 1, which illustrates an apparatus 100 structured to receive and contain a bullet in motion and to aid in determining a penetrative effect, or ballistic effect, of the bullet relative to at least one material disposed within an internal confines of the apparatus. Optionally, more than one material can be disposed in the apparatus and can be tested. Apparatus 100 is shown as including an elongated central core 102. As will be shown in more detail later, this elongated central core 102 is hollow and includes an internal cavity structured to house the material being tested. The internal cavity is structured to facilitate ballistic penetrative testing on the material. The material being tested is disposed in the internal cavity. Also, an absorption unit is disposed in the internal cavity.

The elongated central core 102 can be made from any number of different materials that are sufficiently durable so as to contain a bullet that is shot from a firearm. Example materials include, but are not limited to, any type of steel (e.g., stainless steel), iron, aluminum, lead, hard rubber, titanium, carbon fiber, and so on. Indeed, any type of material that is sufficiently robust to contain a bullet can be used. In some cases, multiple different types of materials can be used concurrently. In some cases, different alloys can also be used. A thickness of the elongated central core 102 can optionally be between ⅛" to about ½". In some embodiments, the thickness is about ¼". The length and height will be discussed later.

Apparatus 100 also includes a funnel-like member 104, which has a wider opening facing a direction away from the body (e.g., the elongated central core 102) of the apparatus 100 and a narrower opening facing a direction toward the body of the apparatus. The funnel-like member 104 can be coupled to the elongated central core via one or more connection members, such as connection member 106. In this example scenario, the connection member 106 is a bolt that screws into a female hole of the elongated central core 102. Other connection techniques can also be used. The funnel-like member 104 can also be welded to the elongated central core 102. In some scenarios, the unit is cast as a single piece. The thickness of the funnel-like member can be the same or comparable to the thickness of the elongated central core. In some cases, the thickness of the funnel-like member 104 is thicker nearer the elongated central core 102 and is thinner near its edge region.

The wider opening of the funnel-like member can be about 6" in diameter. In some cases, the diameter of the wider opening can be within a range spanning 4" to about 8". Other dimensions can be used as well, however.

The narrower opening of the funnel-like member can include an extended length that is of a same size and that connects the funnel-like member to the elongated central core. Optionally, the length of this extended length can be anywhere from about 0.5" to about 1.5".

As mentioned, the funnel-like member can include a narrower opening. From the commencement of that narrower opening, a cylinder portion or rectangular prism portion can be formed that extends the length of the narrower opening. In some embodiments, the narrower opening is about ⅓ the size of the wider opening.

When a bullet is shot at the apparatus, it is typically desirable that the bullet is shot directly into the confines of the elongated central core 102 without striking the funnel-like member 104. Sometimes, however, that might not be the case, and the bullet might strike the funnel-like member 104. Due to the curvature properties of the funnel-like member 104, when a bullet does strike the funnel-like member 104, that member will guide the bullet into the confines of the apparatus. Optionally, the edges of the funnel-like member 104 can be rounded to further assist in guiding the bullet if the bullet happens to strike the edge of the funnel-like member 104. In any event, the bullet is guided by the walls of the funnel-like member 104 into the intermediary section (e.g., the cylinder portion or rectangular prism portion) that connects the funnel-like member 104 to the elongated central core 102.

Different sized funnel-like members can be used. In fact, the different sized funnel-like members can be interchanged with one another to accommodate different caliber of bullets or different sized elongated central cores. The funnel-like member operates to guide the bullet into the receiver (i.e. the internal cavity).

Typically, the narrower opening is circular or ovular in shape. In some cases, however, it can have a different shape, such as a polygon. Similarly, the wider opening is also typically circular or ovular in shape. Sometimes, however, it can have a polygonal shape.

The narrower opening provides a single, directed entry into the internal cavity of the elongated central core 102. Additionally, the funnel-like member 104, based on its conical shape, is structured to guide the bullet into the internal cavity.

For instance, suppose a technician or operator is pointing a gun in the direction of the apparatus 100. It is desirable for the bullet to pass through the center of the funnel-like member 104 without contacting the curved walls of the member. However, as indicated above, that may not always occur. Due to the conical shape of the member 104, if the bullet does strike the curved wall, the bullet will be guided into the internal cavity and contained by the apparatus 100.

Similar to the elongated center core 102, the funnel-like member 104 can be comprised of various different materials, such as those mentioned previously. In some instances, the funnel-like member 104 is made of the same material as the elongated central core 102 while in other instances the funnel-like member 104 is made of a different material than the elongated central core 102.

Apparatus 100 also includes a removable lid 108, or a detachable lid. The lid 108 is structured to couple to the elongated central core 102. When the lid 108 is coupled to the elongated central core 102, a combination of the elongated central core 102 and the lid 108 cause the previously-mentioned internal cavity to become a "sealed" internal cavity save for (except for) the one directed entry section through which the bullet in motion can enter the internal cavity.

Recall, the directed entry section is formed by the narrower opening of the funnel-like member 104. As the bullet passes through the narrower opening, it enters a more expansive chamber (i.e. the sealed internal cavity). The bullet can then strike a material disposed within this chamber. After striking the material, the bullet may continue on its trajectory or it may be deflected. Eventually, the bullet will strike an absorption unit disposed at a rear end of the apparatus. Further details on these aspects will be provided later.

In any event, the sealed internal cavity will contain the bullet, even if it begins to ricochet. The dimensions of the sealed internal cavity are designed to be larger than the dimensions of the narrower opening. It is typically the case that the shape of the sealed internal cavity is that of a rectangular prism. Other shapes, however, are conceived. For instance, the shape can optionally be that of a cylinder. The thickness of the lid can be the same or comparable as the thickness of the elongated central core. In some cases, the height of the internal cavity can be about 5", such that the height of the elongated central core is about 5.5" (e.g., 5"

plus a ¼" bottom and a ¼" top). In some cases, the height is anywhere from about 4" to about 8".

The lid 108 can optionally have one or more handles, such as handle 110 and handle 112. Optionally, the handles 110 and 112 can be connected to a top portion of the lid 108 via a hinge. The hinge can be a single direction hinge or a multi-direction hinge (e.g., it can rotate in a circular manner while also rotating in an arc). In some implementations, the handles 110 and 112 have knurling to help with gripping the handles 110 and 112. The size of the handgrip portion of the handles can be about ⅞" thick. In some cases, the size can be between about 0.5" and about 1.0". Of course, any size can be used for the handles 110 and 112.

In some implementations, the handles 110 and 112 can include insulated material in the event the apparatus 100 becomes hot from having bullets ricochet inside of it. Accordingly, the embodiments can include a first handle and a second handle. In some cases, the handle portion onto which the hand grip portion is connected is about ¼" thick. In some cases, the handle portion is anywhere from ¼" to about 1" thick.

A first hinge can couple the first handle to the removable lid, and a second hinge can couple the second handle to the removable lid. The removable lid can include a first terminal end and a second terminal end. The first handle can, in some implementations, be closer to the first terminal end than the second handle is to the second terminal end. In some embodiments, the removable lid includes a top section, a first side section, and a second side section.

Optionally, the lid can have one or more tapered sides with rounded edges to allow for easier alignment when connecting to the elongated central core. Optionally, the first side section and the second side section can both be oriented orthogonally relative to the top section. The side sections can be about ⅜" in height. In some embodiments, the height can be within a range of about 0.5" to about 3" in height.

As mentioned previously, the lid 108 is detachable from the elongated central core 102. The removable lid 108 can be coupled to the elongated central core 102 via at least one of: a plurality of connecting bolts or a plurality of round wire lock pins, which can be used to help speed up the process of operating or inspecting the material disposed inside of the internal cavity. In some cases, a latch mechanism can also be used as the connector. FIG. 1 shows a first round wire lock pin 114 and a second round wire lock pin 116 being used to couple the lid 108 to the elongated central core 102.

In some embodiments, the round wire lock pins can be 5/16" by 3" pins. As will be described in more detail later, the removable lid 108 can include one or more drop-down members that are orthogonal to the base or top portion of the lid 108. When the removable lid 108 is coupled to the elongated central core 102, each drop-down member covers a corresponding protruding member affixed to the elongated central core 102. A connection member (e.g., the bolt or round wire lock pin) passes through both the drop-down member and the protruding member to seal the removable lid to the elongated member. In some implementations, the drop-down member does not contact the side wall of the elongated central core. In some cases, the drop-down member also does not come into contact with the sides of the protruding member of the elongated central core, as will be discussed in more detail later. When a bolt is used as the connection member, then the top of the protruding member may be in contact with the inside bottom of the drop-down member.

Optionally, the drop-down member can be about 3" in height, meaning that it drops down from the top portion of the lid about 3". In some cases, the height is within a range spanning about 1" to about 4".

When the apparatus 100 is being moved or used for ballistic testing, a set of socket head cap screws or bolts can be used to secure the lid to the elongated central core. Doing so allows the lid to be snugly fit to the elongated central core.

Apparatus 100 can also include a first base support 118 and a second base support 120. Optionally, a set of plastic end caps can be provided on the base supports. These base supports 118 and 120 help stabilize the apparatus. In some implementations, the base supports 118 and 120 can be rigidly coupled to a frame to prevent the apparatus 100 from moving when it is shot by a bullet. The base supports 118 and 120 can optionally have a width that spans the width of the elongated central core 102. Optionally, the width can be wider than the elongated central core 102, and the wider length can allow for those base supports to be bolted or otherwise secured to a table or other platform. In some cases, the base supports 118 and 120 can be shaped as rectangular prisms. In other embodiments, the base supports 118 and 120 have different shapes or widths. In some cases, the base supports 118 and 120 can be protruding nobs.

Optionally, a width of the base support can be between about 0.5" to about 1.5". Often, the size is about 1". The front-positioned base support can be located about 0.5" from a front plate or front section of the elongated central core. The rear-positioned base support can be located about 0.5" from a back plate or back section of the elongated central core.

Figure 2:
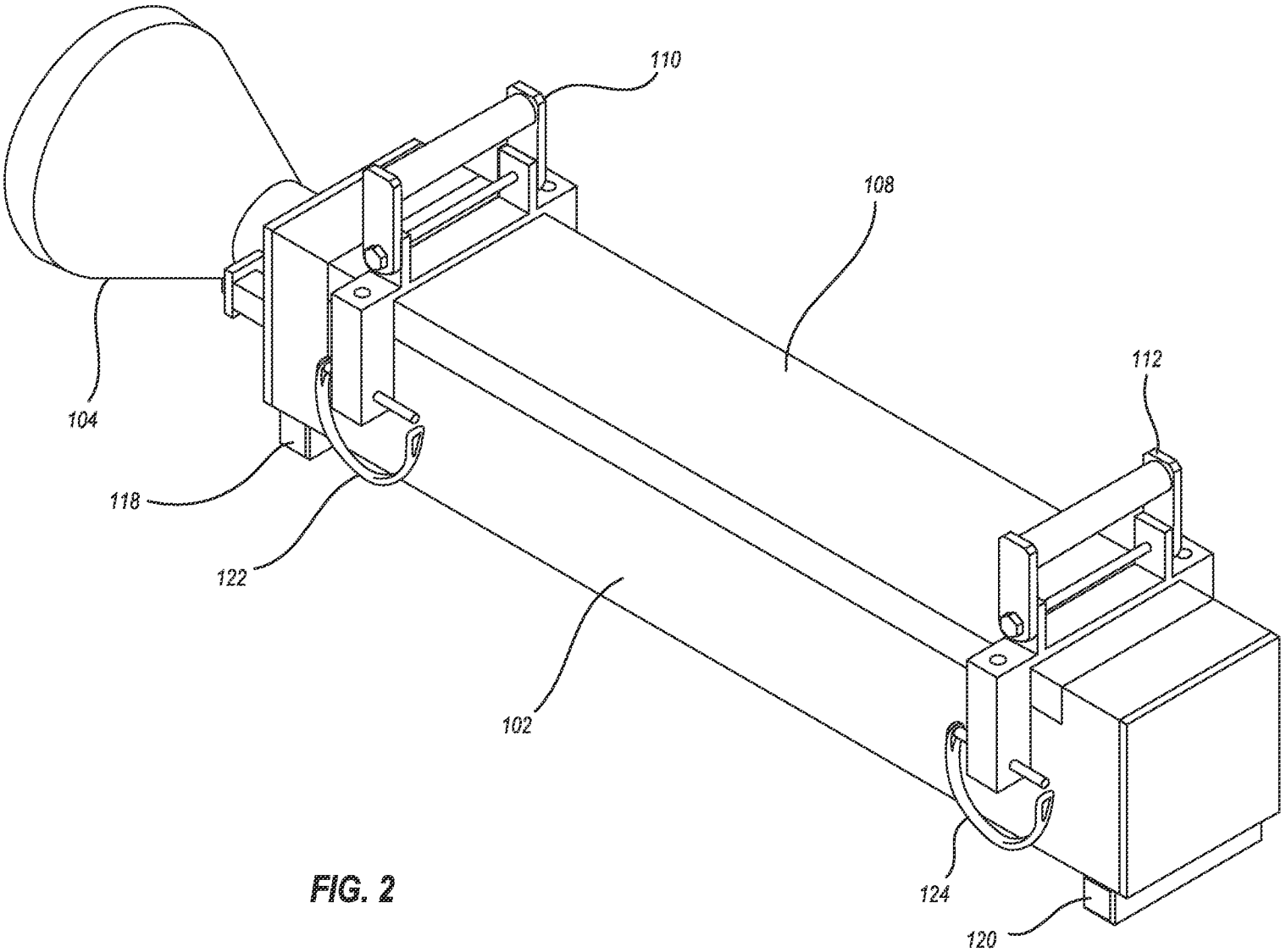
FIG. 2 illustrates another angled perspective view of the apparatus.

FIG. 1 shows a side, front angled view of the apparatus 100. For reference purposes, the wider opening of the funnel-like member 104 can be considered the "front" of the apparatus. Thus, from the front, the round wire lock pins 114 and 116 can be considered to be on the "left" side of the apparatus 100. Consequently, FIG. 1 is currently showing the left and top sides of the apparatus 100. FIG. 2, on the other hand, is currently showing the right and top sides of the apparatus 100.

From the vantage point in FIG. 2, one can now observe two additional round wire lock pins 122 and 124. Thus, in some embodiments four coupling members can be used to couple the removable lid 108 to the elongated central core 102. In some embodiments, additional coupling members can also be used, where those members can include round wire lock pins and/or bolts.

FIG. 2 also now reveals a rear or back side of the apparatus 100 (i.e. the side opposite the funnel-like member 104). In some, though not all, embodiments (not shown), the rear end of the apparatus 100 can include a guide rod (aka a bolt). The guide rod can slide within a bushing provided by the apparatus. A terminal end of the guide rod can include threading to thread into a female portion of an absorption unit, which is provided to reduce and/or stop the force of the bullet. The guide rod can pass through a back plate or section of the elongated central core as well the absorption unit. The amount or length of threading on the guide rod can vary. In some cases, the length of threading is about 1¼" in length. Not all embodiments include this guide rod, however.

Although not currently shown (though mentioned above), an absorption unit is disposed in the internal cavity of the elongated central core 102. This absorption unit is provided to help absorb the impact of the bullet. Further details on this aspect will be provided later.

Figure 3:
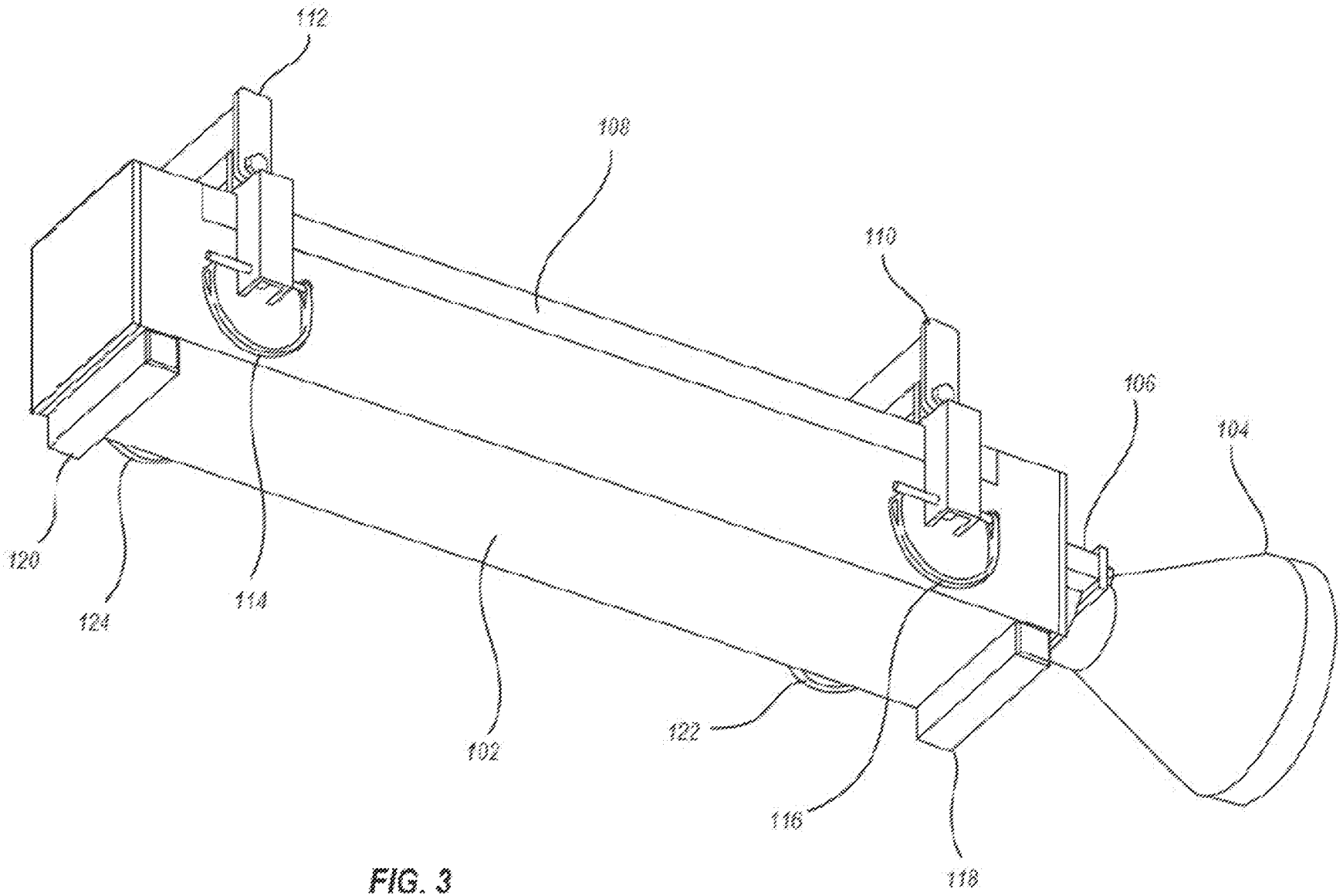
FIG. 3 illustrates another angled perspective view of the apparatus.

FIG. 3 is currently showing the left and bottom sides of the apparatus 100. From this vantage, one can now readily observe the base supports 118 and 120.

Figure 4:
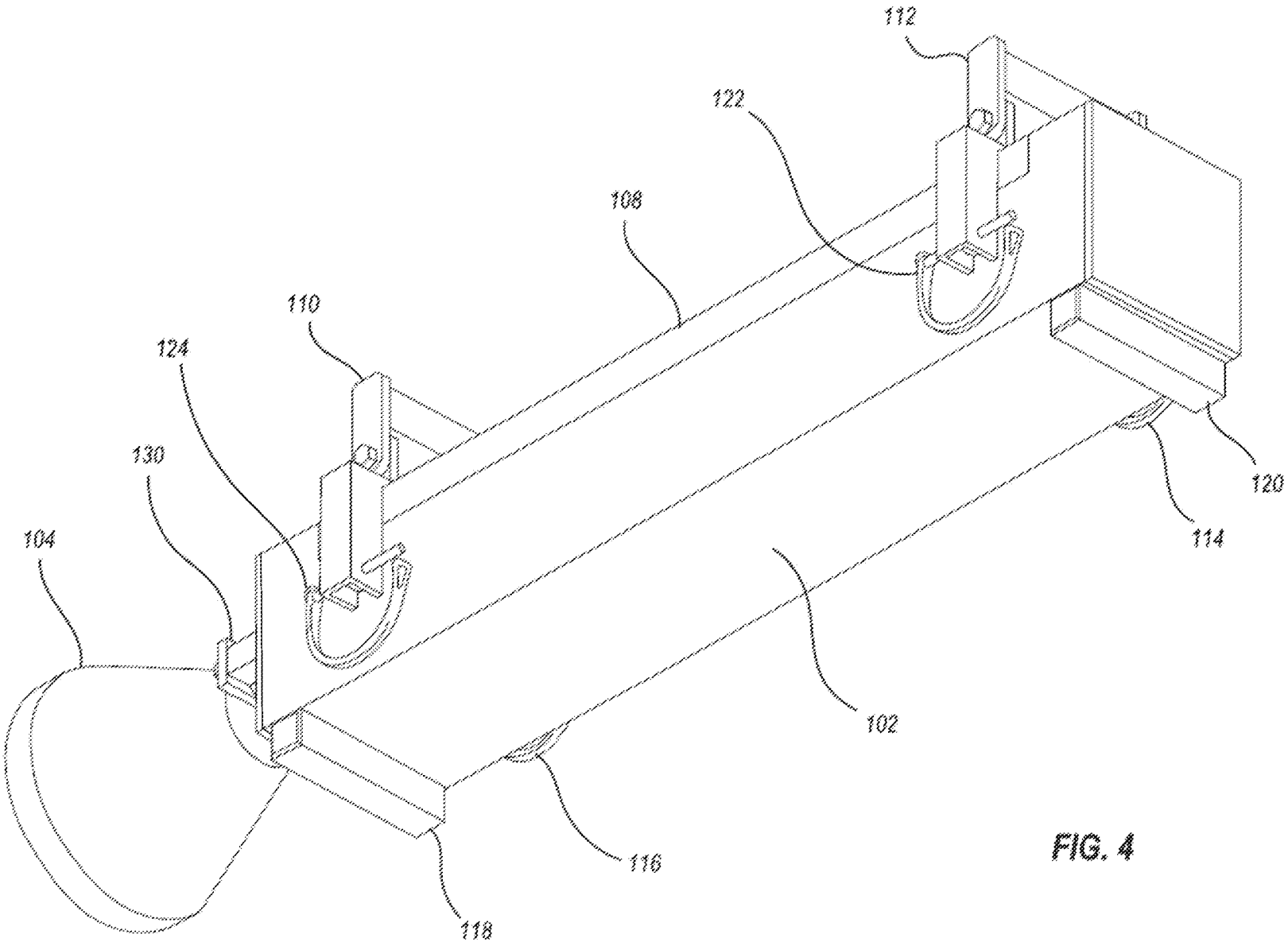
FIG. 4 illustrates another angled perspective view of the apparatus.

FIG. 4 now shows the right and bottom sides of the apparatus 100. FIG. 4 also points out another connection member 130 that can be used to couple the funnel-like member 104 to the elongated central core 102. As a result, some embodiments include two connection members (e.g., connection member 106 and connection member 130) to couple the funnel-like member 104 to the elongated central core 102. Optionally, these connection members 106 and 130 can be a screw-in bolt. In some embodiments, the connection members 106 and 130 are located on opposite sides of the apparatus 100.

Figure 6:
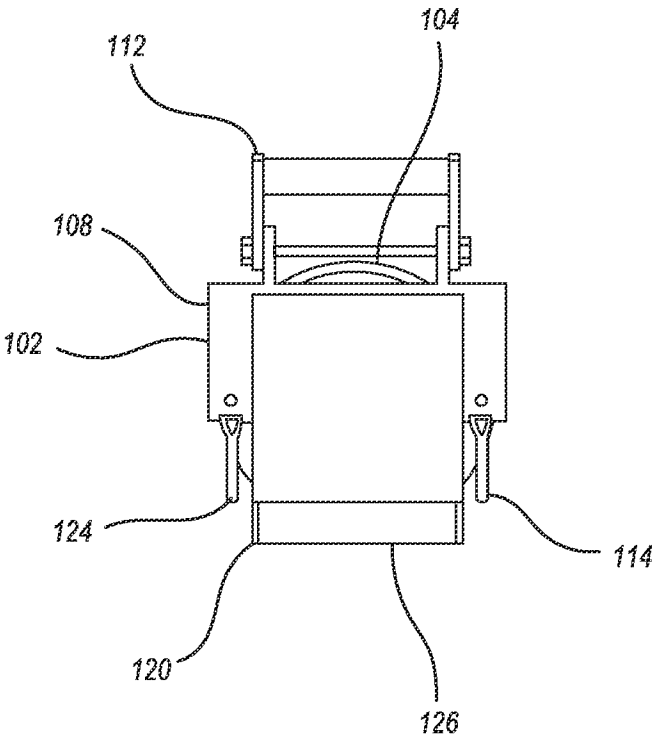
FIGS. 5 and 6 illustrate a front facing view and a back facing view of the apparatus, respectively.
Figure 5:
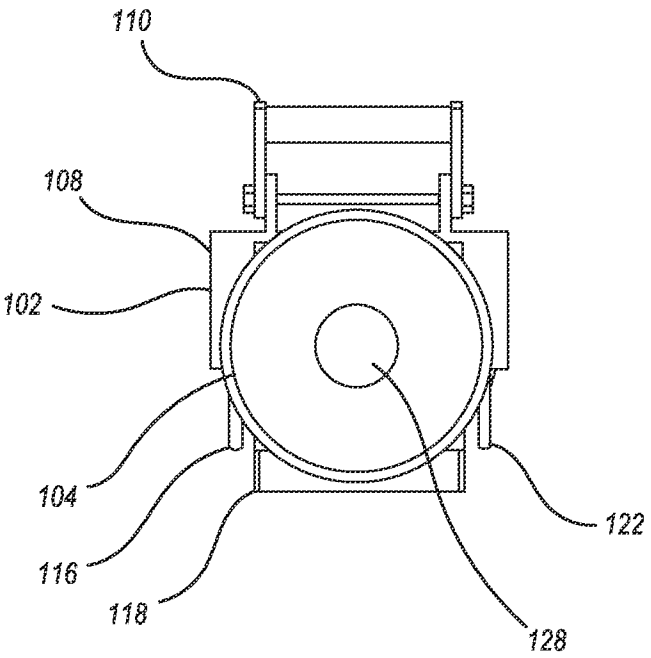

FIG. 5 shows both a front perspective view, and FIG. 6 shows a rear perspective view of the apparatus. In addition to the previous elements that have been introduced, FIG. 5 shows the narrower opening 128 of the funnel-like member 104. Notice, the narrower opening 128 is significantly smaller in diameter than the outer or wider opening of the funnel-like member 104. In some implementations, the size relationship between the narrower opening 128 and the wider opening is such that the diameter of the narrower opening 128 is less than 50% the diameter of the wider opening. In some cases, the diameter of the narrower opening 128 is less than 25% the diameter of the wider opening. In some embodiments, the size of the narrower opening is about 1¼" in diameter. In some embodiments, the diameter of the narrower opening is within a range spanning about 1" to about 3". Other dimensions can also be used, as will be discussed throughout this document.

FIG. 6 shows the rear or back panel of the elongated central core 102. When a guide rod is used, it is typically positioned in a central region of the back plate of the elongated central core 102. In some implementations, its placement can be offset relative to the central position of the back plate.

Figure 7:
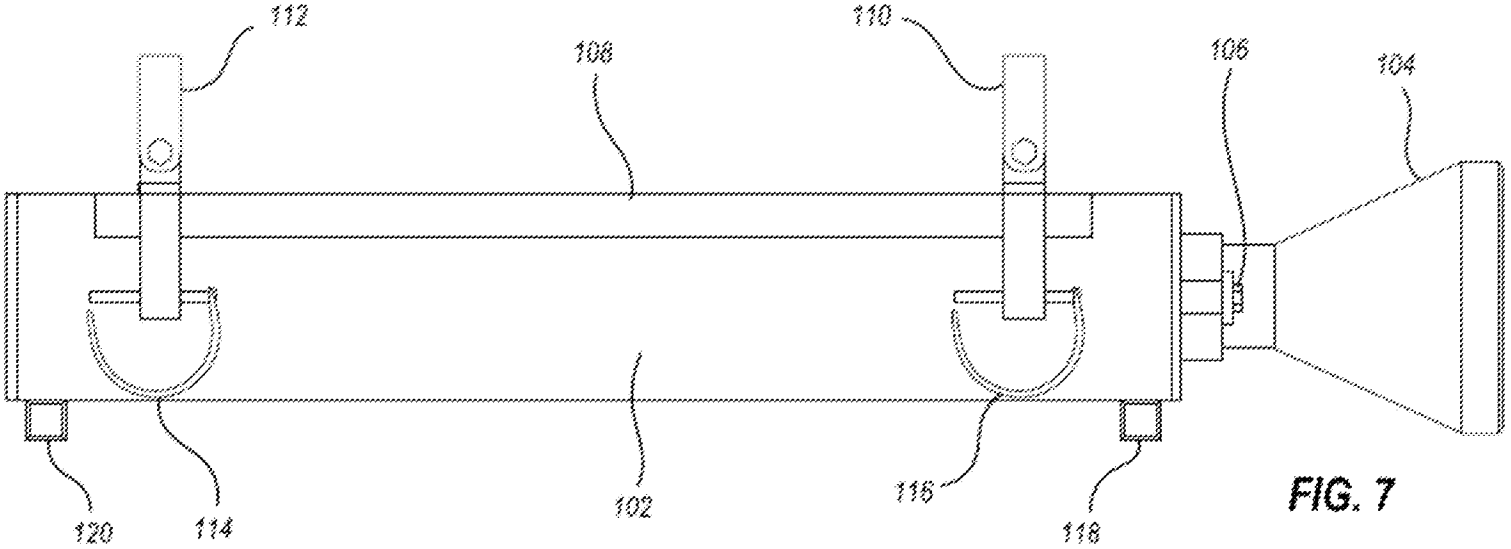
FIGS. 7 and 8 illustrate a first side view and a second side view of the apparatus.
Figure 8:
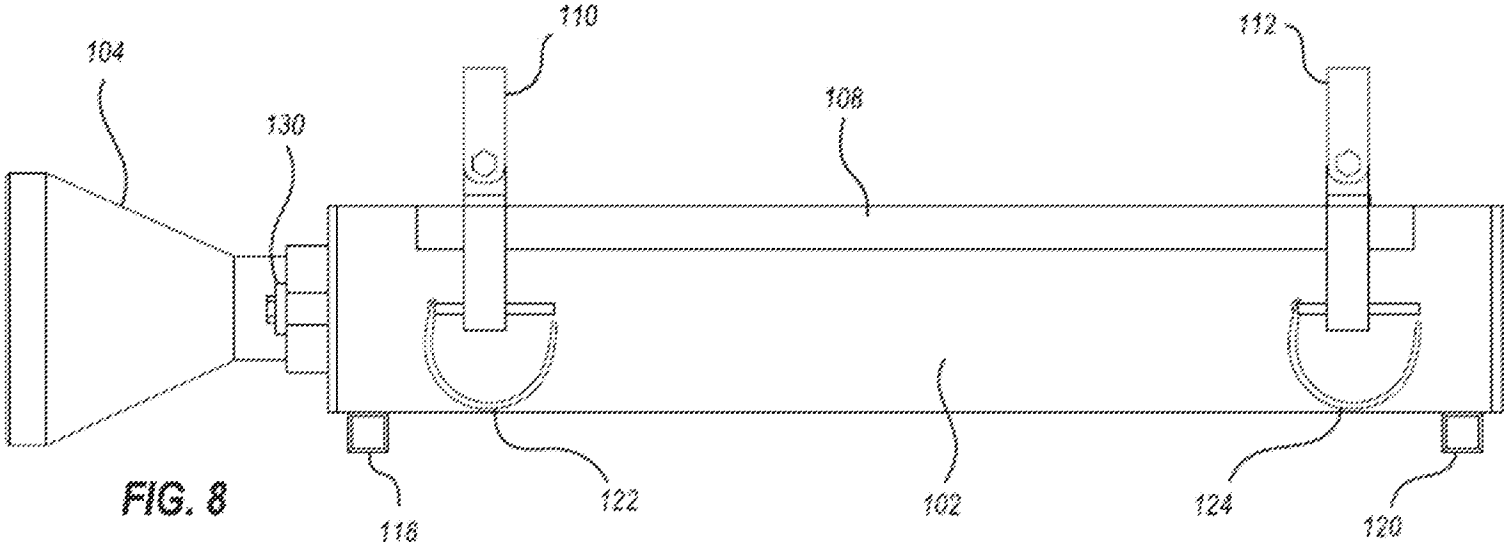

FIG. 7 shows the lefthand side of the apparatus 100, and FIG. 8 shows the righthand side of the apparatus 100. The connection member 106 is shown on the lefthand side while the connection member 130 is shown on the righthand side. Similarly, the round wire lock pins 114 and 116 are shown on the lefthand side while the round wire lock pins 122 and 124 are shown on the righthand side.

Figure 9:
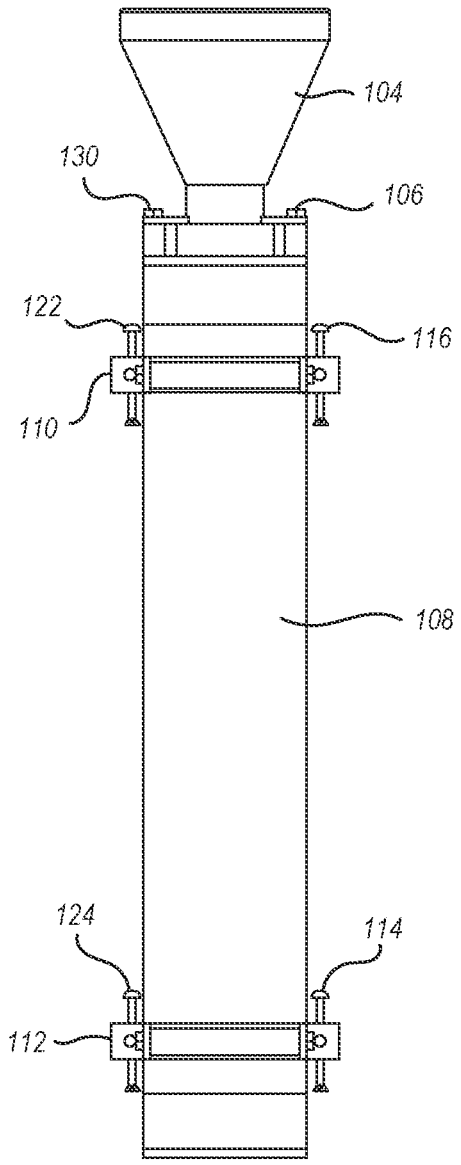
FIGS. 9 and 10 illustrate a top-looking-down view and a bottom-looking-up view of the apparatus, respectively.
Figure 10:
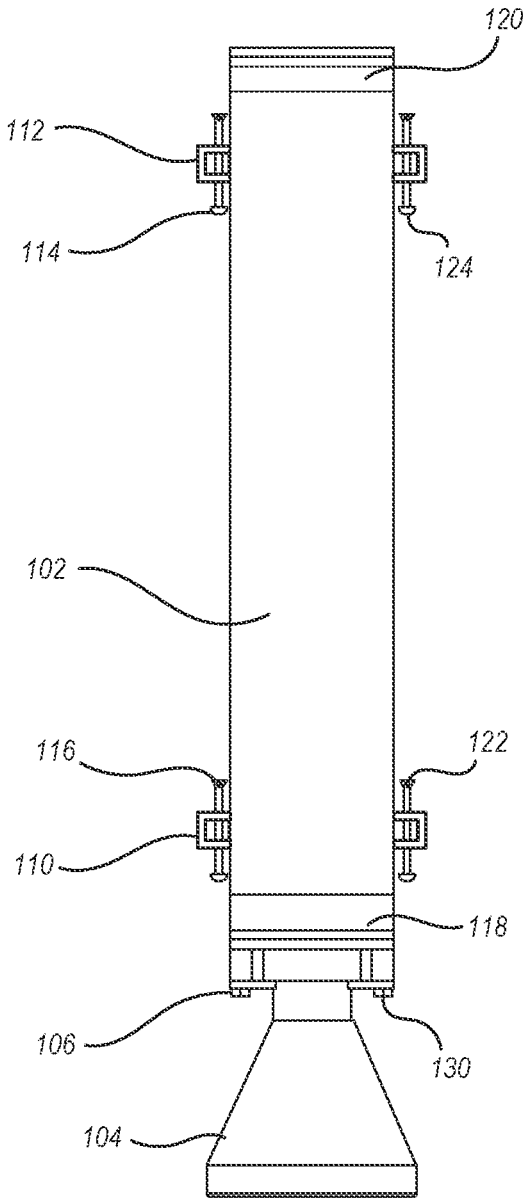

FIG. 9 shows a top-looking-down aerial view of the apparatus 100 on the lefthand side of the figure. FIG. 10 also shows a bottom-looking-up view of the apparatus 100.

Figure 11:
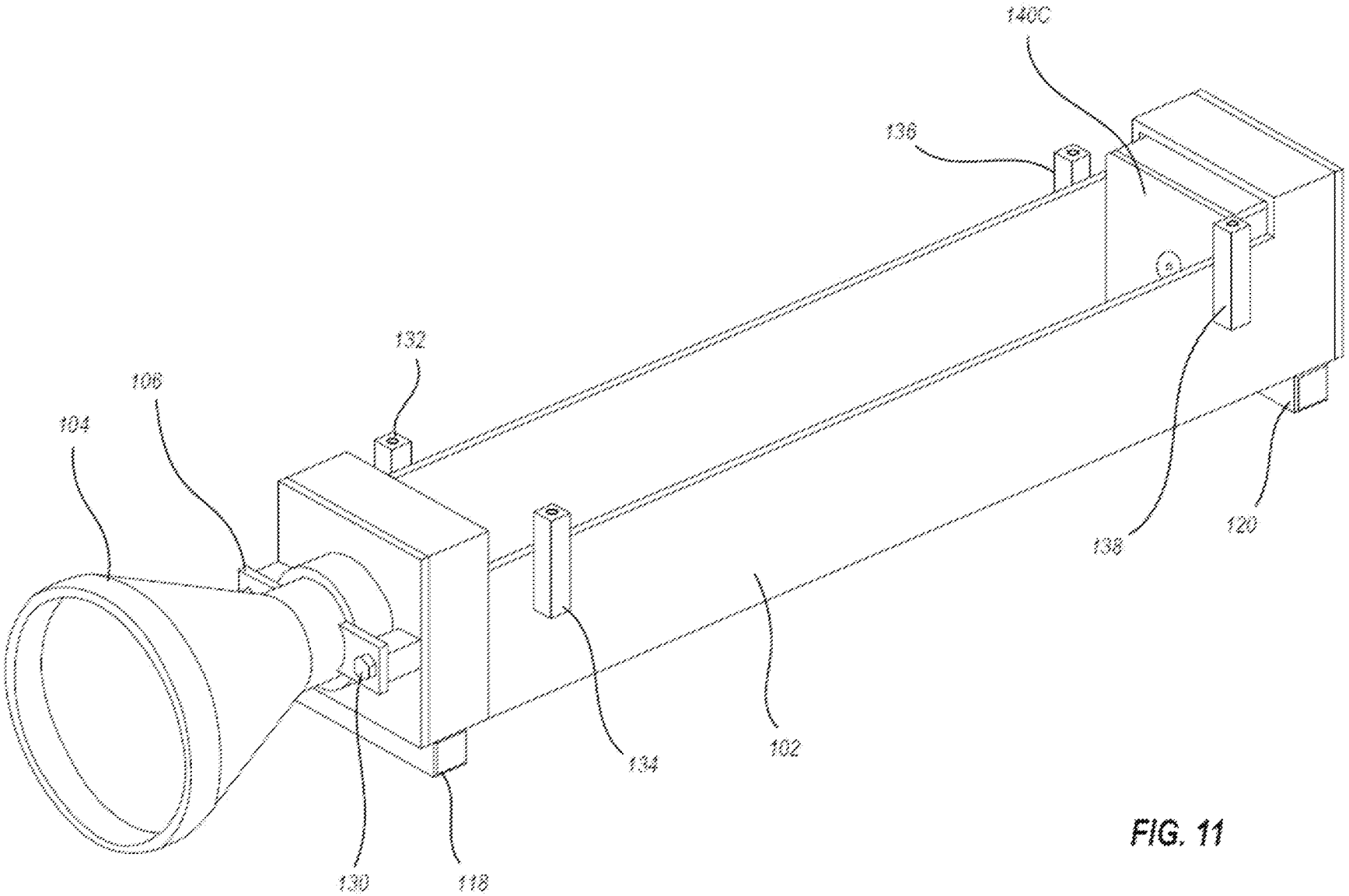
FIG. 11 illustrates an angled perspective view of the apparatus without the lid.

FIG. 11 shows a scenario where the removable lid 108 has been removed, thereby revealing the internal cavity of the elongated central core 102. FIG. 11 also shows a number of protruding members 132, 134, 136, and 138, as mentioned previously.

In particular, the protruding members include the following protruding members 132, 134, 136, and 138. As mentioned previously, the lid 108 includes some drop-down members that can overlap or cover these protruding members 132, 134, 136, and 138. In some cases, there is a buffer space between the drop-down members and the protruding members such that the sides of the drop-down members do not come into direct contact with the sides of the protruding members. The protruding members can extend outwardly away from the elongated central core about ¾" or more. The internal portion of the drop-down members can be about 15/16", thereby providing a buffer space between the drop-down member and the protruding member. In some cases, the width of the protruding member is about ¾" while the internal width of the drop-down member is about 1⅛".

In some embodiments, the front-facing protruding members are about 3" from the front plate of the elongated central core. In some cases, the distance from the front plate is within a range of about 2" to about 4".

The protruding members 132 and 134 are positioned near the front of the apparatus 100. The protruding members 136 and 138 are positioned near the rear of the apparatus 100. The protruding members 132, 134, 136, and 138 extend or protrude outwardly and to the side relative to the elongated central core 102. The protruding members are also positioned on the sides of the elongated central core 102. As a result, the protruding members protrude in a direction that is orthogonal to the direction of the hole or opening that is considered to be the directed entry section into the internal cavity.

FIG. 11 also shows the absorption unit 140C, which includes a plywood pad, a bullet shield, a foam unit, and a bumper holder. Further details on this absorption unit will be provided later. By way of a quick introduction, however, the absorption unit 140C is shown as being disposed near the rear of the apparatus 100. Because the absorption unit 140C includes multiple different components, the absorption unit 140C is often comprised of different types of materials. Some of the components of the absorption unit 140C are formed of a material that can withstand the impact of a bullet. For instance, the absorption unit 140C can include a plywood pad, a steel bullet shield, a foam unit, and a bumper holder. The plywood pad can provide an initial striking point for the bullet. The plywood pad can abut or be immediately adjacent to the bullet shield. If the bullet penetrates the plywood pad, the bullet will then be stopped by the bullet shield. The absorption unit also includes various springs to help absorb the kinetic energy of the bullet. That is, the absorption unit 140C can include a number of springs surrounded by foam. The combination of the springs and the foam help absorb the bullet's impact. With the springs in place, the absorption unit 140C can move and can better absorb the energy of the bullet and can help prevent the bullet from ricocheting. Further details on this absorption unit will be provided later.

Figure 12:
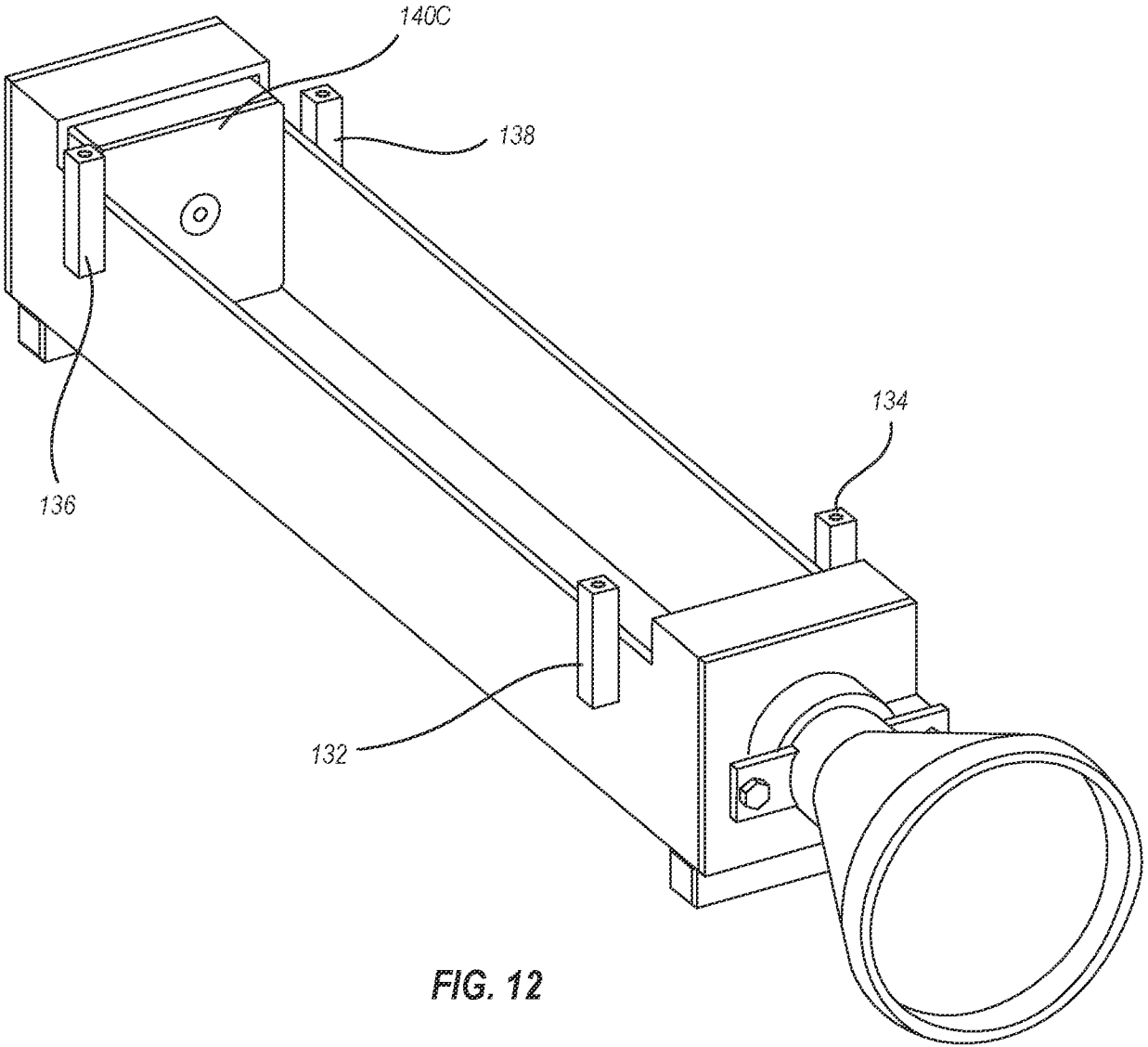
FIG. 12 illustrates another angled perspective view of the apparatus without the lid.

FIG. 12 shows an alternative viewpoint of the apparatus 100 as well as the internal cavity and the absorption unit 140C. The various different protruding members 132, 134, 136, and 138 are also visible.

Figure 13:
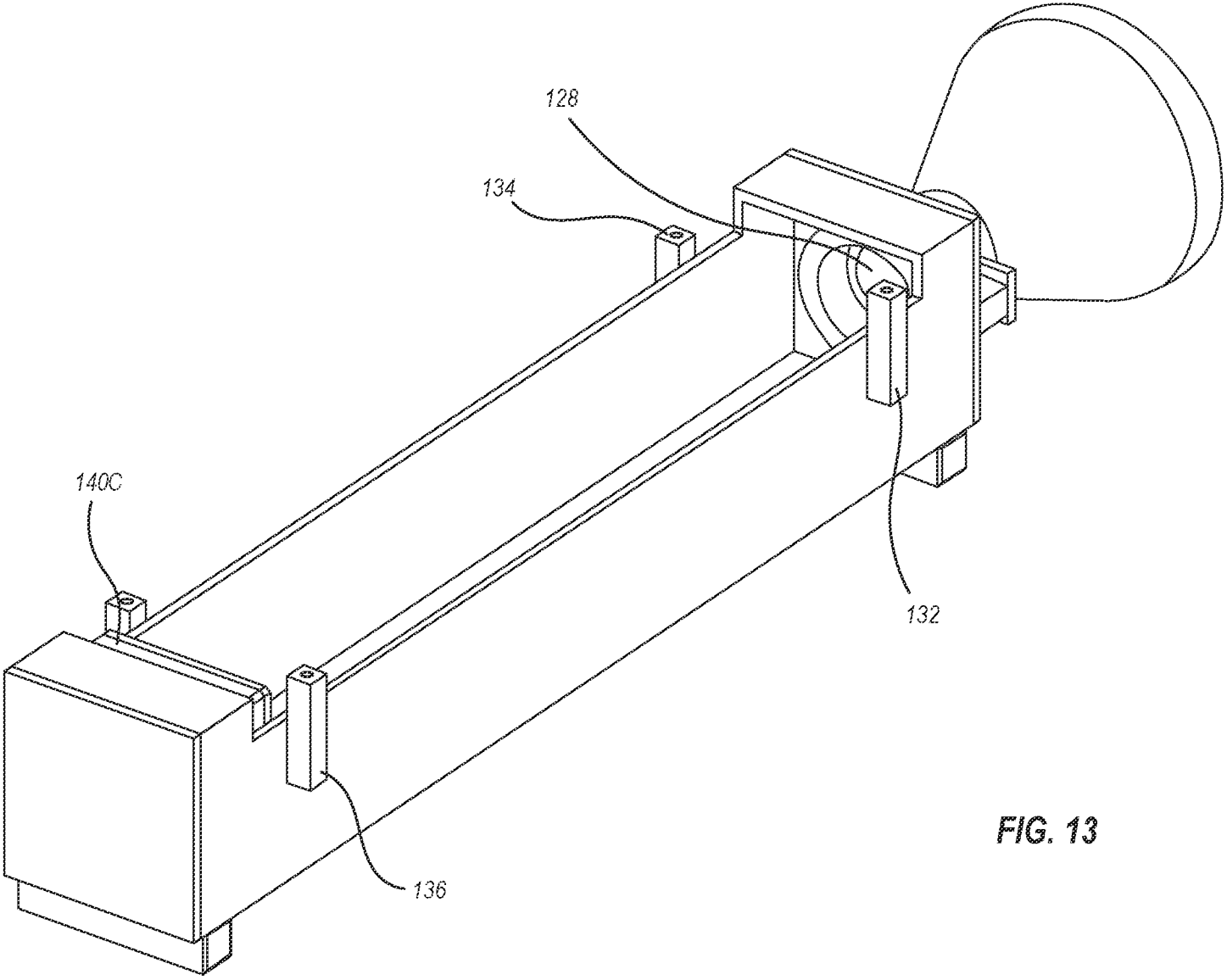
FIG. 13 illustrates another angled perspective view of the apparatus without the lid.

FIG. 13 shows another vantage of the apparatus. Here, the narrower opening 128, which can also be considered as the directed entry, is visible. The bullet will pass through this narrower opening 128 and enter the internal cavity which is currently exposed because the lid has been removed. The bullet will then typically strike a material disposed in the internal cavity and may also strike the absorption unit 140C.

Figure 14:
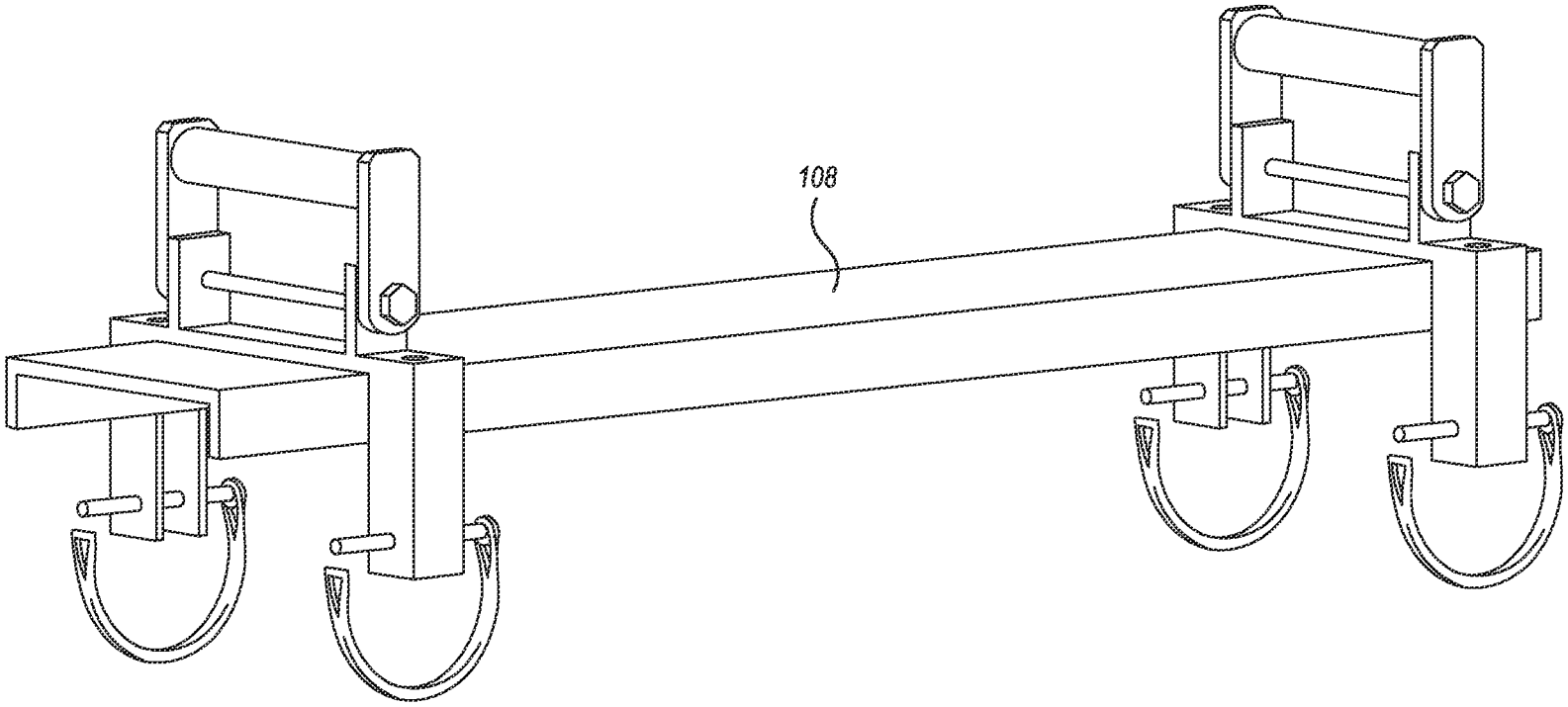
FIG. 14 illustrates a view of the lid.

FIG. 14 shows the lid 108. Notice, the lid 108 includes a number of drop-down members through which the round wire lock pins can be inserted. These drop-down members will overlap or be positioned over top of the protruding members 132, 134, 136, and 138.

Figure 15:
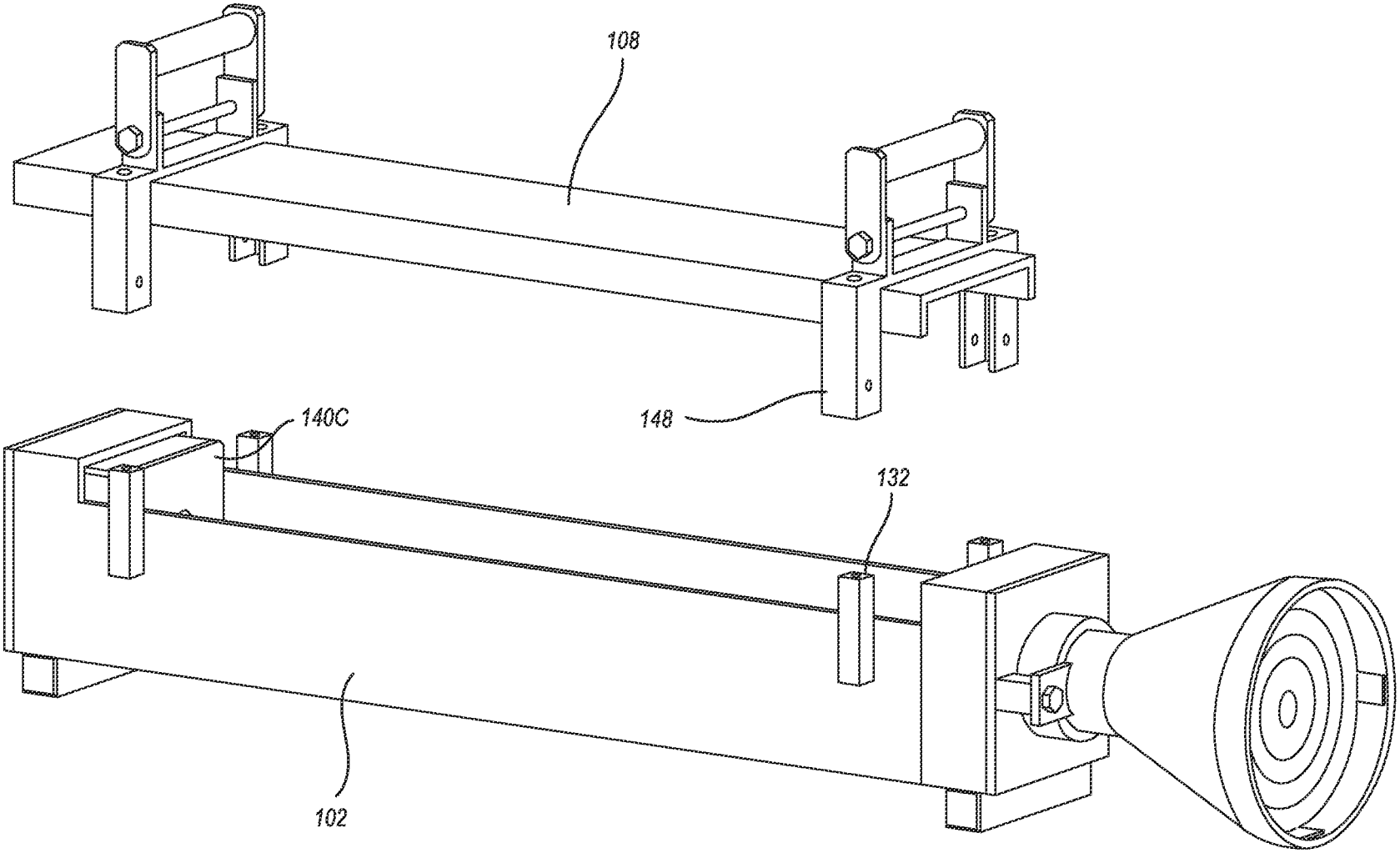
FIG. 15 illustrates the elongated central core and the lid, where the lid is in a removed state.

FIG. 15 shows both the lid 108 and the elongated central core 102. FIG. 15 also has labeled one of the drop-down members, such as drop-down member 148. When the lid 108 is positioned on the elongated central core 102, the drop-down member 148 will cover or overlap the corresponding protruding member 132. The round wire lock pin can then be inserted into holes that are formed in both the drop-down member 148 and the protruding member 132.

As mentioned previously, the lid 108 can include multiple drop-down members, such as drop-down member 148. In this example scenario, the lid 108 includes four drop-down members. The drop-down member 148 is orthogonal to a top base of the lid. The drop-down member also provides a framework or component to enable the lid 108 to be attached to the elongated central core 102 via the connection members. Each drop-down member can include a through hole. A round wire lock pin can then be inserted into this through hole as well as a corresponding through hole in the protruding members. The round wire lock pin can then help secure the lid 108 to the elongated central core 102.

In this example scenario, the drop-down member 148 will fit over or cover the protruding member 132 when the lid 108 is in place. Accordingly, in some embodiments, the removable lid includes a drop-down member that is orthogonal to a base of the lid. When the removable lid is coupled to the elongated central core, the drop-down member covers a protruding member affixed to the elongated central core, and a connection member passes through both the drop-down member and the protruding member to seal the removable lid to the elongated central core. FIG. 15 shows a side perspective view and how the drop-down members are in-line with the protruding members. The drop-down members will cover or overlap the protruding members.

Figure 16:
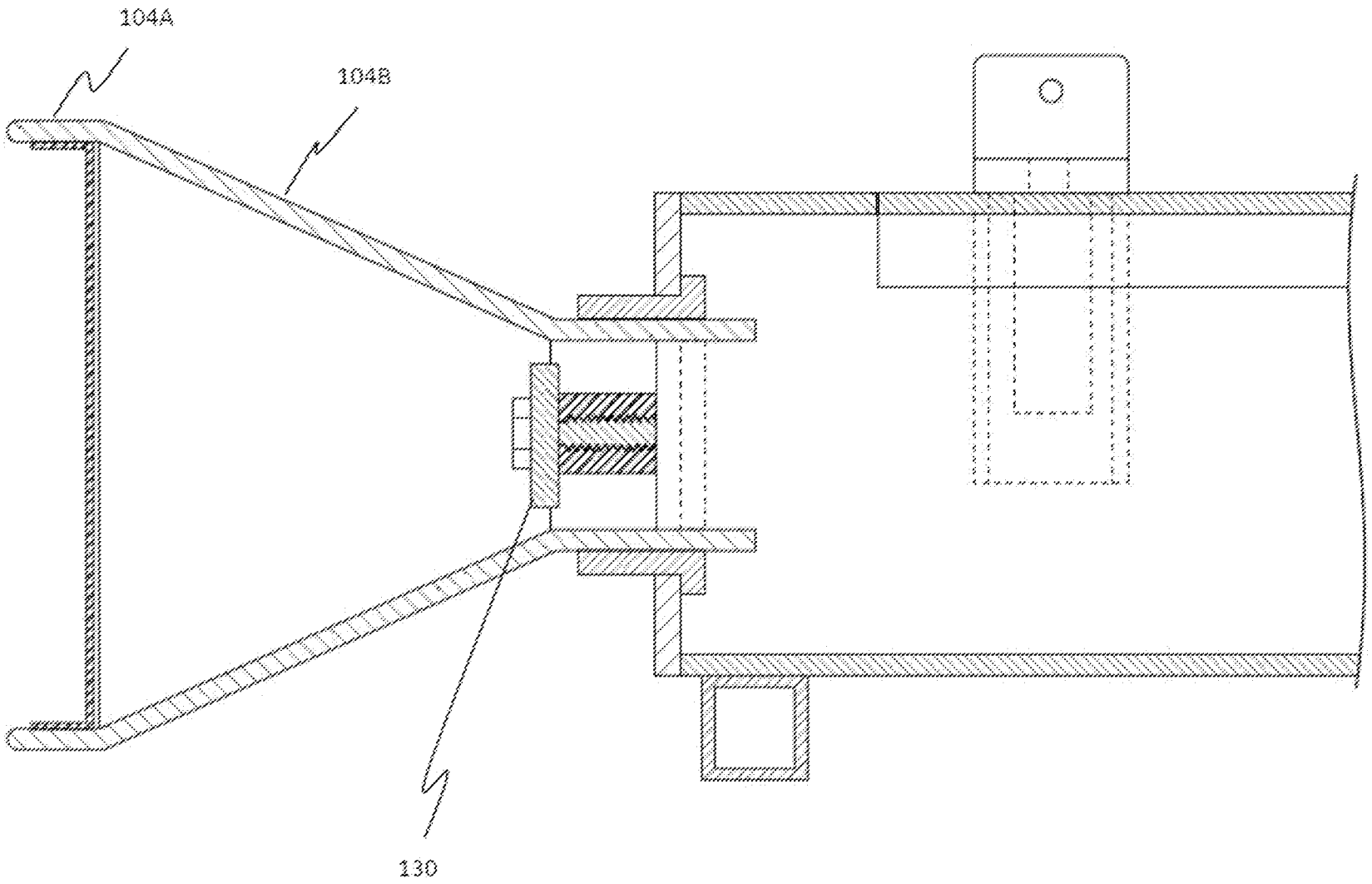
FIG. 16 illustrates a funnel-like member for receiving and directing a projectile into the internal cavity.

FIG. 16 provides further details regarding the funnel-like member. In some embodiments, the front edges of the funnel-like member are rounded, as shown by the rounded edges at the left of FIG. 16. Optionally, the funnel-like member can include an initial straight portion 104A followed by a curved or tapered portion 104B. For instance, viewing the figure from left to right, one can observe how the funnel-like member initially includes a straight portion 104A. Then, the curvature of the funnel-like member begins, and the unit progressively gets smaller, as funnels do, as shown by the tapered portion 104B. FIG. 16 is also currently showing the connection member 130.

Figure 17:
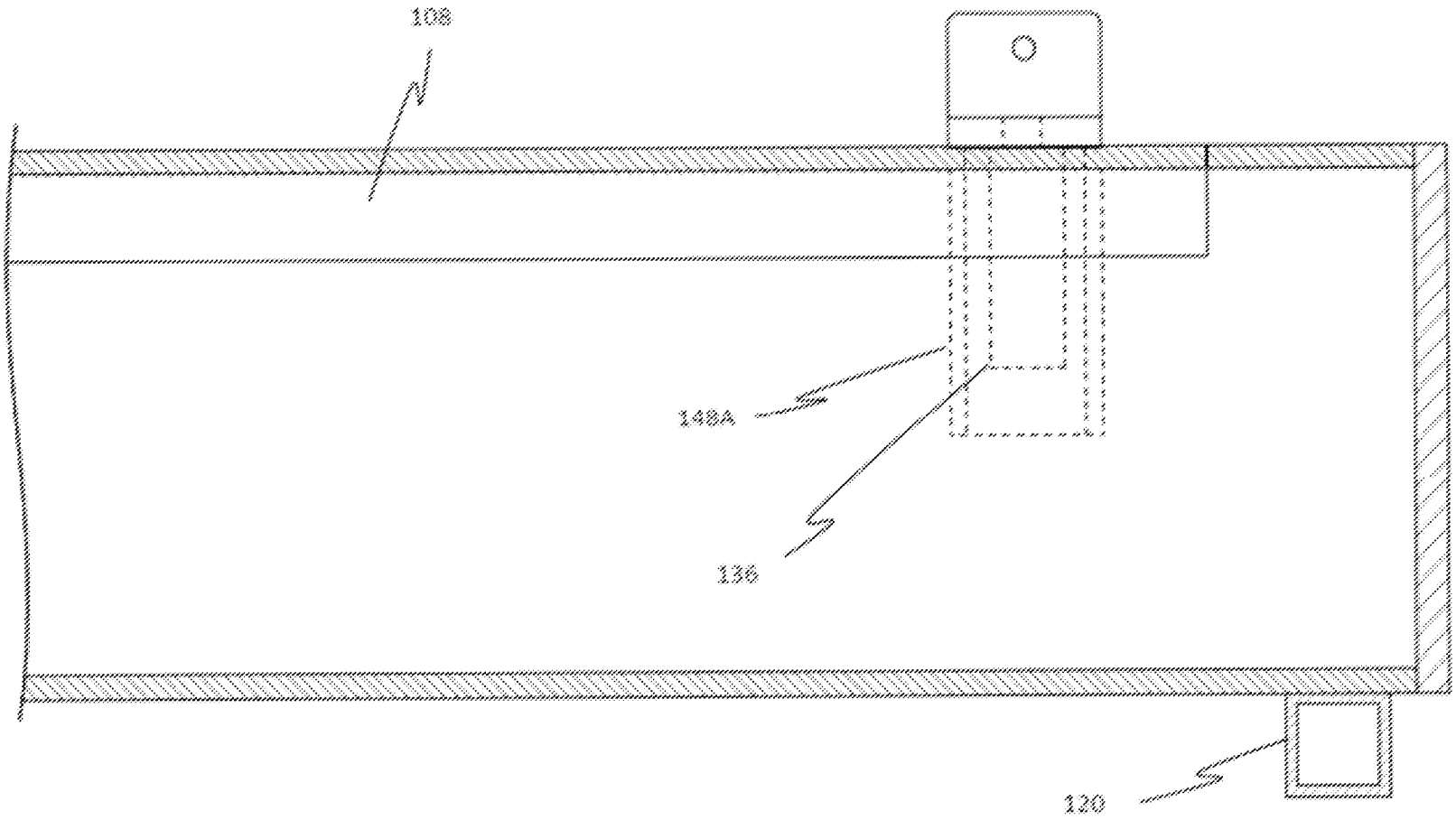
FIG. 17 illustrates a rear end of the apparatus.

FIG. 17 is currently showing the rear portion of the apparatus. FIG. 17 shows the base support 120 and the handle 112. Optionally, the rear section can include components to accommodate the guide rod.

Figures 18, 19:
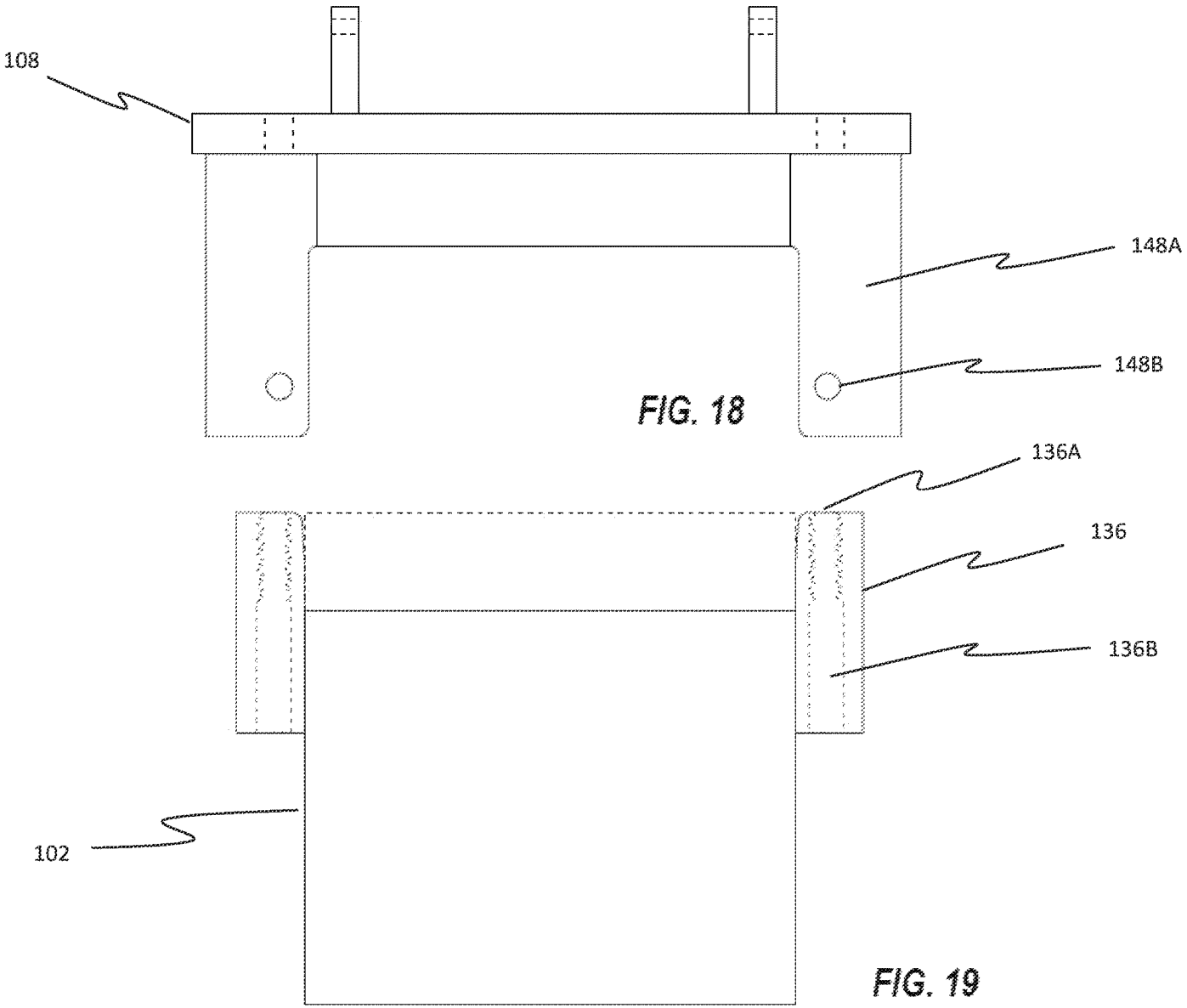
FIG. 18 illustrates the lid.
FIG. 19 illustrates the lid disposed on top of the elongated central core.

FIG. 18 illustrates a front view of the lid 108. The lid 108 includes another drop-down member 148A and a hole 148B through which a pin can be inserted.

FIG. 19 illustrates the elongated central core 102. The lid can be disposed on top of the elongated central core. Various connection members, such as screw-in bolts can be used to securely couple the lid to the elongated central core. The drop-down member 148A on the lid 108 fits over top of the corresponding protruding member 136 on the elongated central core 102.

FIG. 19 shows that the protruding member 136 includes a hole 136A into which a screw-in bolt can be disposed to secure the lid to the elongated central core. The bolt can also enter a corresponding hole on the top of the drop-down member 148A. The protruding member 136 also includes threading 136B for the bolt. Thus, the bolt enters the hole in the drop-down member 148A and can then be threaded into the threading 136B in the protruding member 136.

Figure 20:
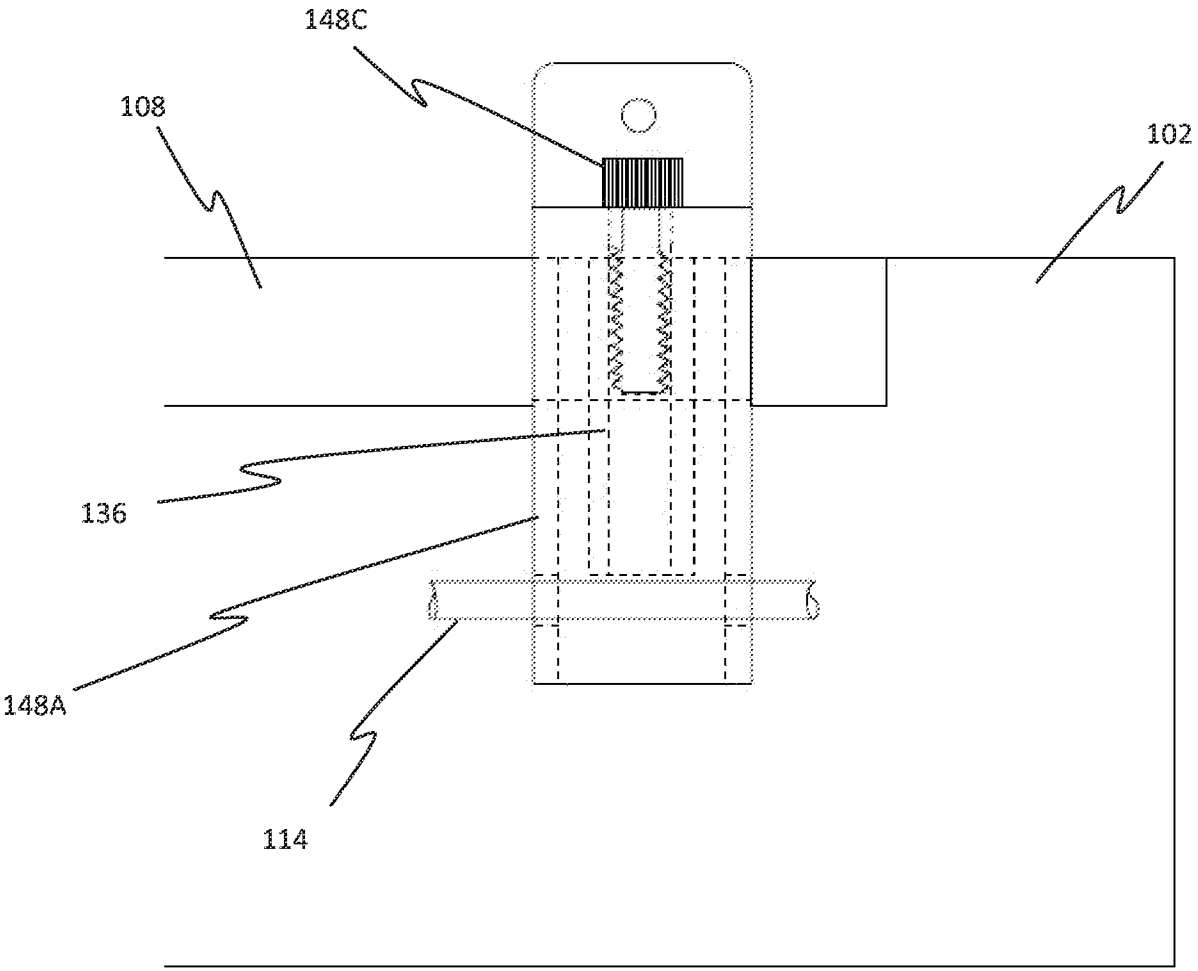
FIG. 20 illustrates the lid disposed on top of the elongated central core.

FIG. 20 shows a scenario where the lid 108 is positioned on top of the elongated central core 102. The drop-down member 148A is disposed on top of the protruding member 136 (shown using dashes because it is covered). A bolt 148C is used to couple the lid 108 to the elongated central core 102. The bolt 148C is inserted into a hole on top of the drop-down member 148A and then into the hole 136A from FIG. 19 and then into the threading 136B. FIG. 19 also shows the pin 114 being inserted through the protruding member 136 and the drop-down member 148A.

Figure 21:
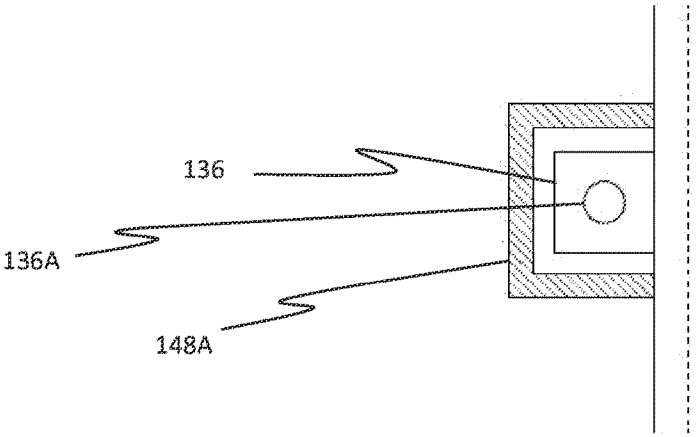
FIGS. 21, 22, and 23 illustrate various connection mechanisms of the apparatus.

FIG. 21 shows the protruding member 136 with the hole 136A. FIG. 21 also shows how the drop-down member 148A is positioned around, but not necessarily contacting (on the sides), the protruding member 136.

Figure 22:
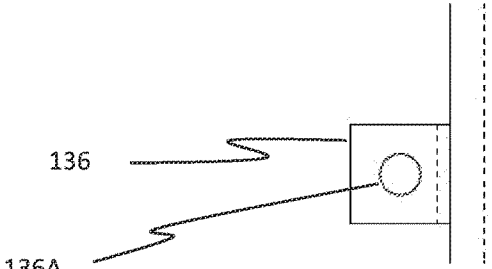
Figure 23:
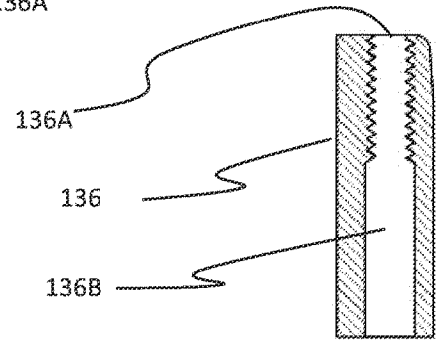

FIG. 22 shows only the protruding member 136 and the hole 136A. FIG. 23 shows a side view of the protruding member 136, the hole 136A, and the threading 136B.

Figure 24:
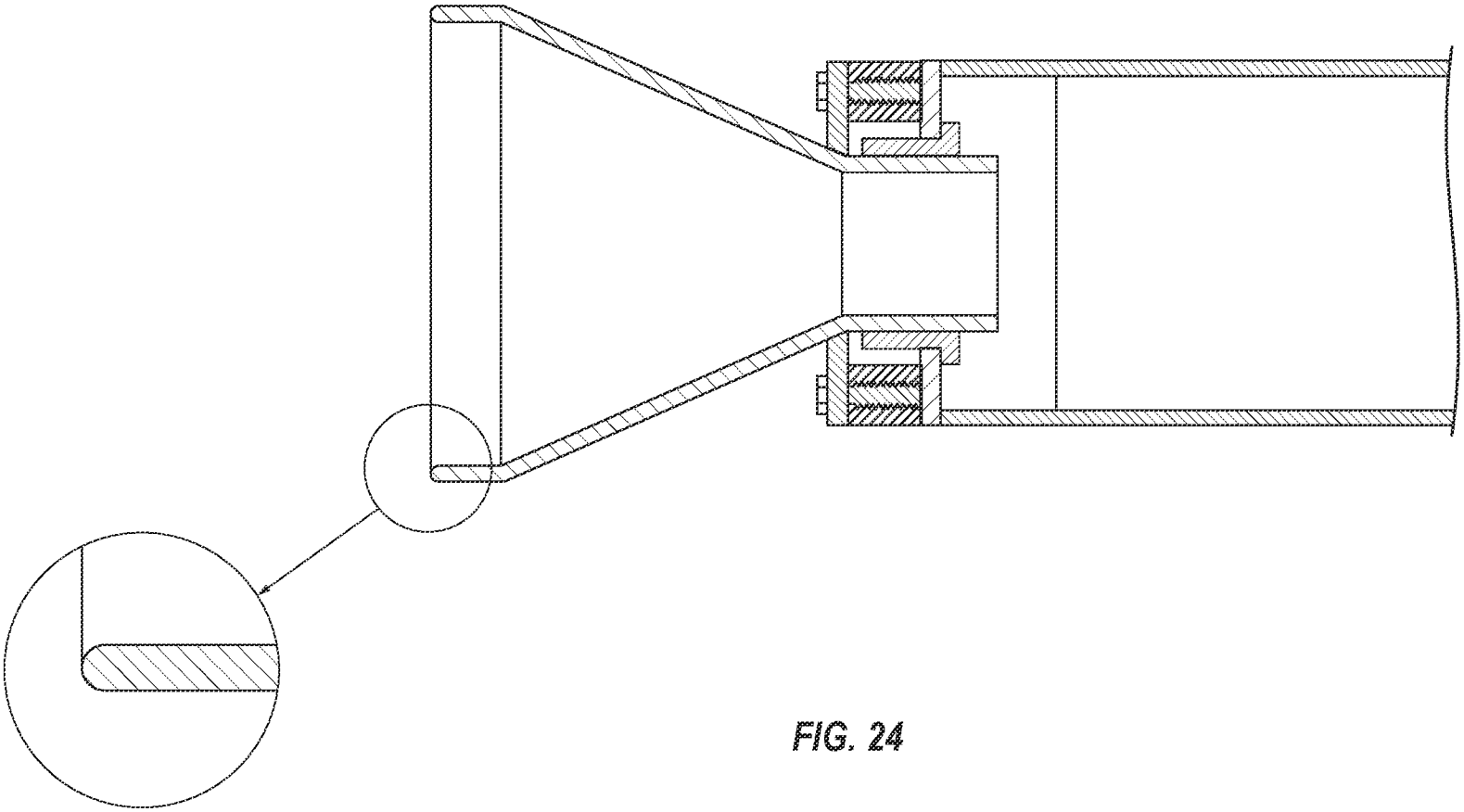
FIG. 24 illustrates further details regarding the funnel-like member.
Figure 25:
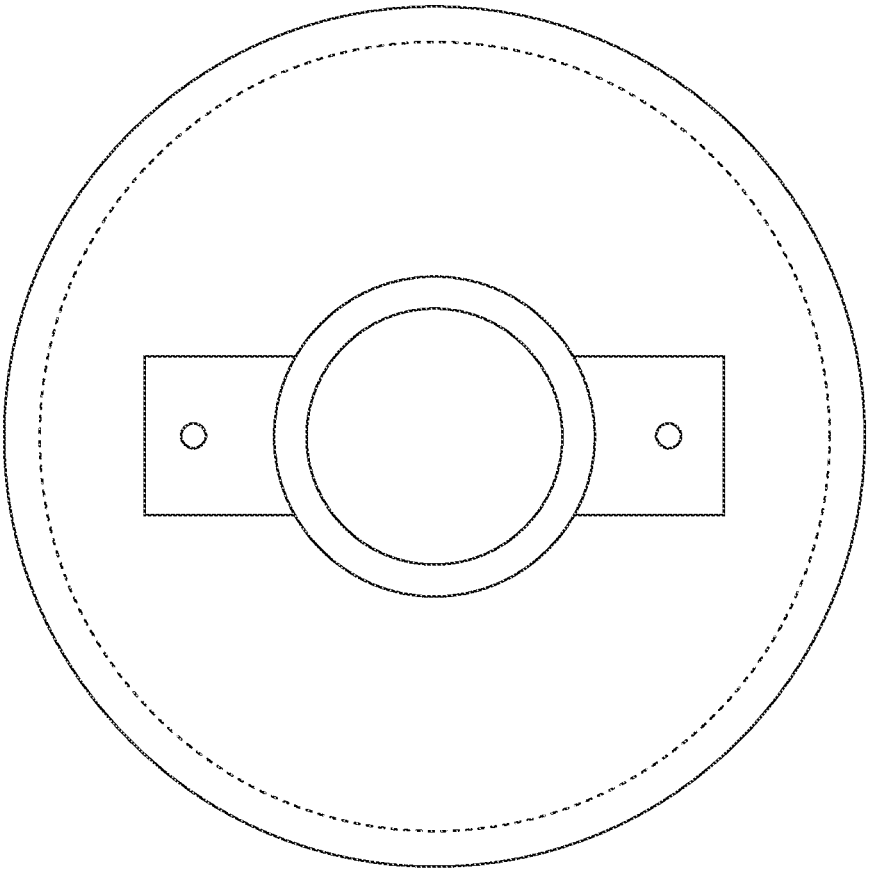
FIG. 25 illustrates further details regarding the funnel-like member.

FIG. 24 again shows the funnel-like member. A specific call out is provided to illustrate how the edge of the funnel-like member can be rounded. FIG. 25 shows a front-facing view of the funnel-like member, including its connection members to connect to the elongated central core.

Figure 27:
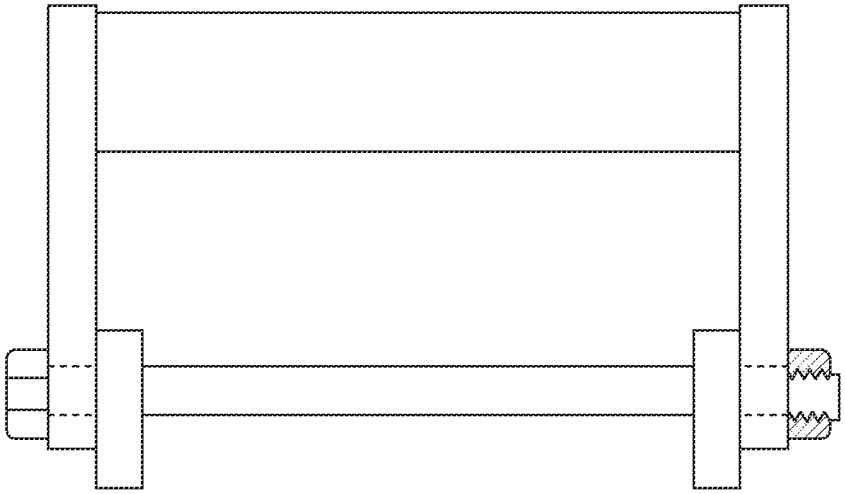
FIGS. 26 and 27 illustrate handholds for the lid.
Figure 26:
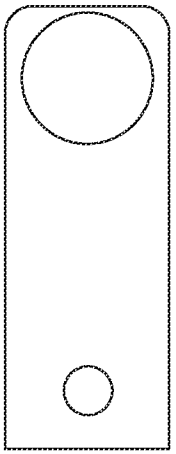

FIGS. 26 and 27 show various perspectives of the handles. As described previously, the handles can be hinge handles such that the handles can move in an arc. Optionally, the handles can include a pivot that allows them to rotate with respect to the lid.

Figure 28:
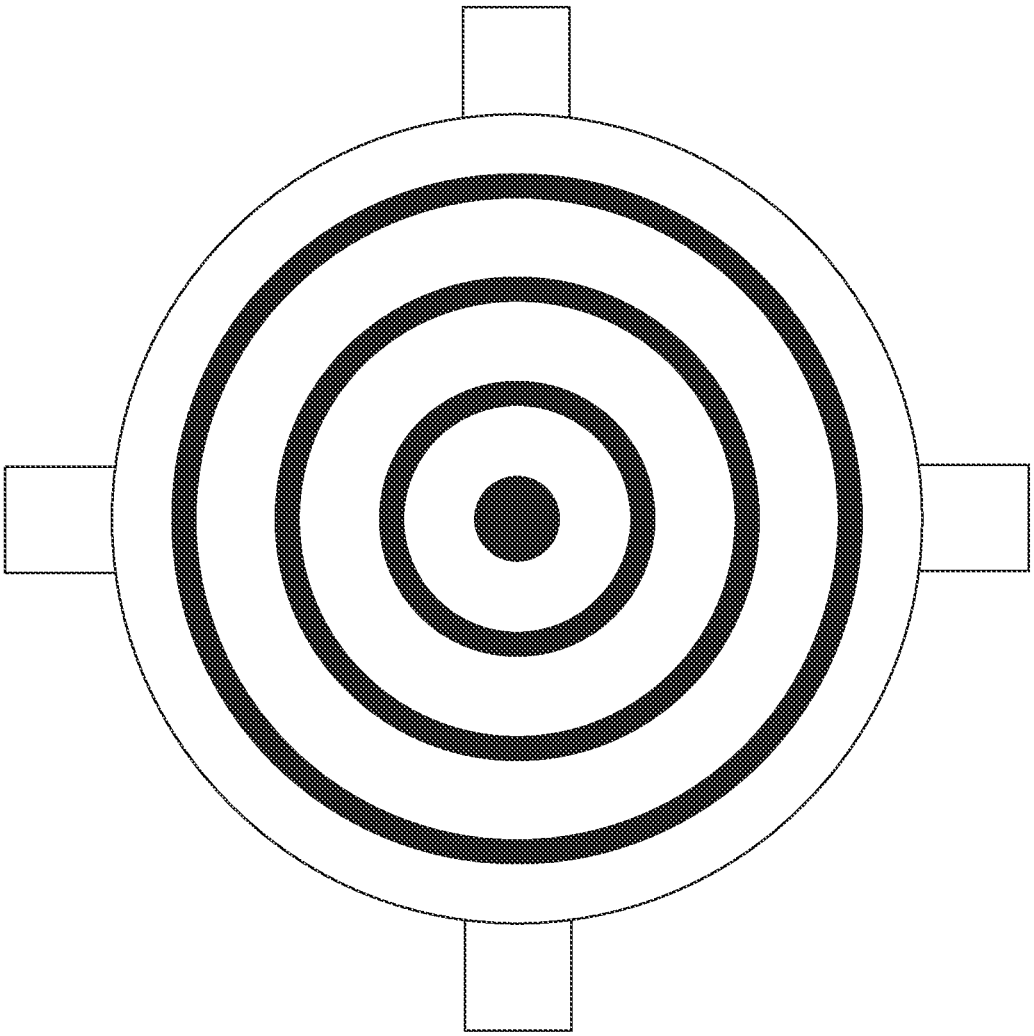
FIG. 28 illustrates an insertable target that can be inserted into the funnel-like member.

FIG. 28 illustrates an example of a target. This target can be made of any easily-permeable material, such as paper or cardboard. The target is place inside of the funnel-like member and provides an aiming tool to help the technician.

The target can be disposed in the wider opening of the funnel-like member 104. The target can have any type of illustration on it. Further, the target is made of a thin material that will not deflect the bullet's trajectory. For instance, the target can be made from paper, cardboard, or perhaps even cloth. Optionally, the target can include handles that can be bent in order to provide a secure fitting within the wider opening of the funnel-like member. The width of the target corresponds to the width of the wider opening.

The target can include 1, 2, 3, 4, or more than 4 foldable handles and can be inserted into the funnel-like member. A target without a bullet hole means that no bullet has entered the apparatus, so no inspection is needed. The presence of any bullet in the target means that a bullet has entered the apparatus and an inspection can be performed. Whenever there is a hole in the target, masking tape can be used to patch the hole and the target can be used again.

Figure 30:
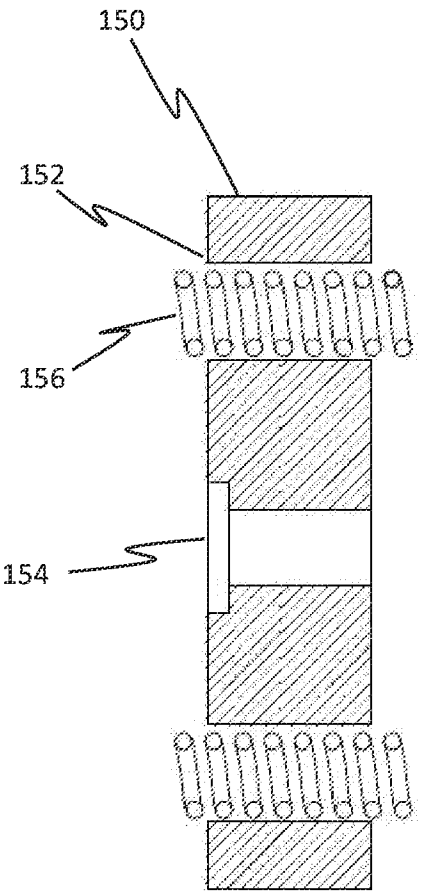
FIGS. 29 and 30 illustrate a foam unit and springs of the apparatus, where the foam unit and springs are a part of an absorption unit.
Figure 29:
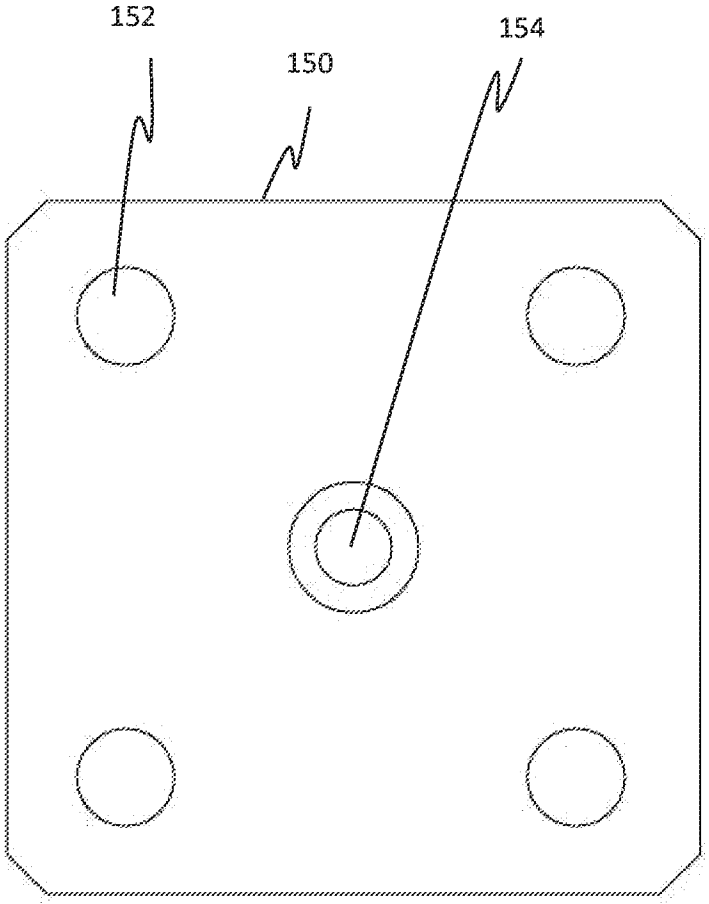

FIGS. 29 and 30 show a foam and spring unit, which are included as parts of the absorption unit 140C mentioned previously. Specifically, FIG. 29 shows a foam unit 150 that includes four corresponding holes, one of which is labeled as hole 152. In the middle of the foam unit 150 is an additional hole 154, which accommodates a so-called stabilizing mechanism, which will be introduced shortly. FIG. 30 again shows the foam unit 150 and the hole 152. In accordance with the disclosed principles, a spring 156 can be disposed in the hole 152. Each of the holes (one of which is hole 152) can accommodate a corresponding spring. The combination of the foam unit 150 and the springs allows this unit to absorb some of the impact from the bullet. This foam unit 150, as will be shown in more detail later, is positioned at the rear end of the apparatus.

Figure 31:
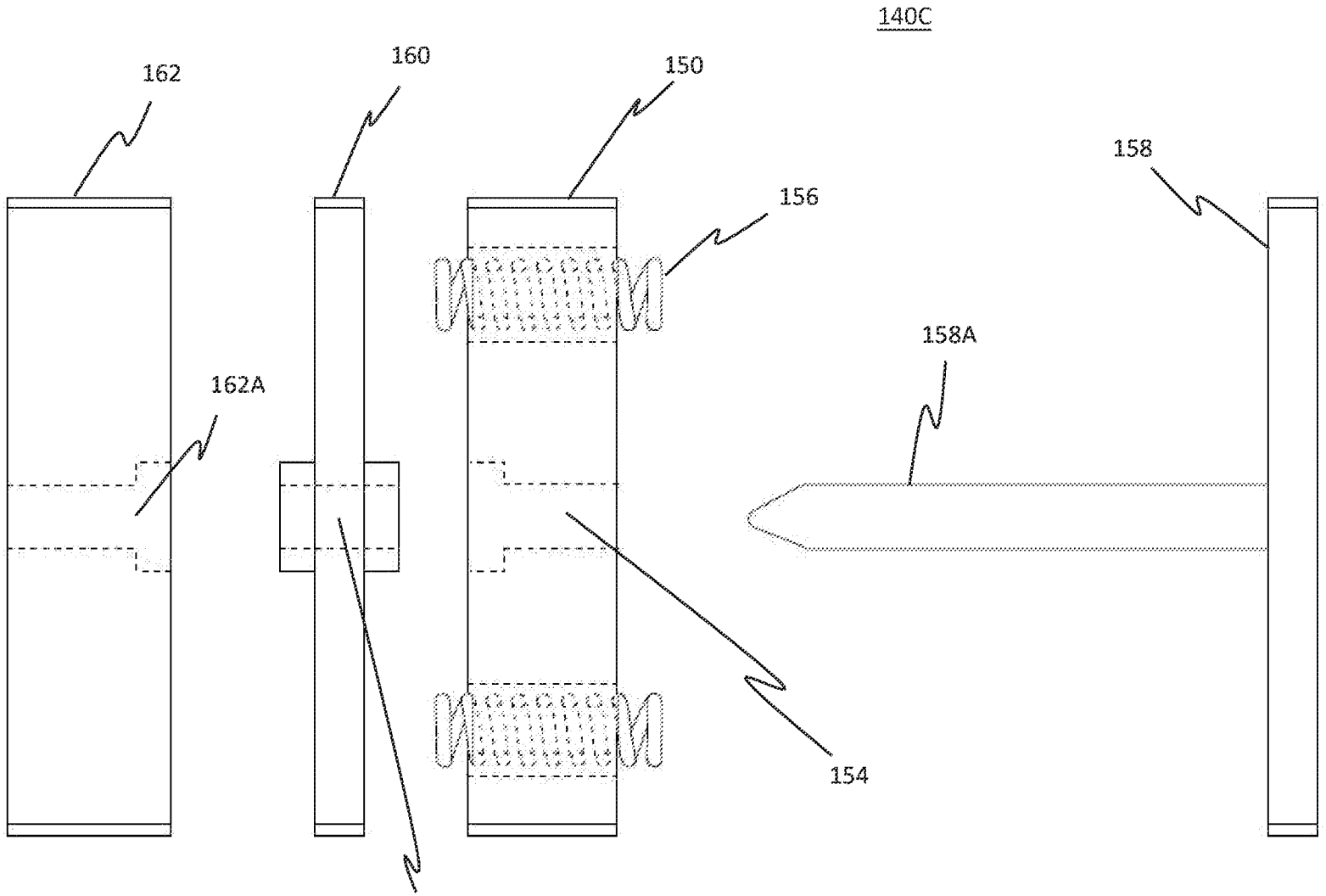
FIG. 31 illustrates the absorption unit.

FIG. 31 shows an absorption unit 140C used to absorb the impact from the bullet. This absorption unit 140C is disposed inside of the internal cavity of the elongated central core. Typically, this absorption unit is disposed on the rear end of the apparatus.

The absorption unit 140C includes a bumper holder 158 that includes a stability mechanism 158A, which is a protruding portion of the bumper holder 158. The absorption unit 140C further includes the foam and spring unit, as shown by foam unit 150 and spring 156. As mentioned previously, it is typically the case that there are four springs. The foam unit 150 also includes the hole 154. The stability mechanism 158A is inserted into the hole 154 and provides stability for the foam unit 150.

The absorption unit 140C further includes a bullet shield 160 that includes a central through hole 160A. The stability mechanism 158A will also be inserted through the bullet shield 160. The bullet shield 160 is typically formed of a solid material that can withstand and impede a bullet in motion. As an example, the bullet shield 160 is often made of steel or some other hard metal.

The absorption unit 140C further includes a plywood pad 162 that includes a hole 162A. The stability mechanism 158A will also be inserted into the hole 162A.

As far as directionality, the bullet is shot into the apparatus. The bullet will strike a material that is being test. The bullet might permeate that material or it might not. The bullet and/or the bullet and material combination will then strike the plywood pad 162. The bullet might partially or fully go through the plywood pad 162. The bullet shield 160, however, will not be permeated by the bullet. The impact of the bullet will cause the absorption unit 140C to recoil, thereby contracting or compressing the springs, thereby absorbing the impact.

The tip of the stability mechanism 158A, in some embodiments, fully extends through the plywood pad 162. The tip is rounded. In addition to providing stability for the various parts of the absorption unit 140C, the tip of the stability mechanism 158A can help with rerouting the bullet. For instance, if the bullet strikes the tip, because of its rounded nature, the bullet will be deflected and will remain in the internal cavity.

In some embodiments, the dimensions of the bumper holder 158 are approximately 4⅜ inches high and about ¼ inch thick. The stability mechanism 158A is approximately 3.5 inches long and about 0.5 inches thick. The foam unit 150 is approximately 1 inch thick. The bullet shield 160 is approximately ⅜ inches thick, with the middle section being about ¾ inches thick. Notice, the middle section is thicker and can fit inside of respective portions of the plywood pad 162 and the foam unit 150. That is, the plywood pad 162 and the foam unit 150 have an additional hollowed out area where the circumference of the hollowed out area is larger than the circumference of the inner holes. The plywood pad 162 is approximately 1⅛ inches thick. The plywood pad 162 can be considered as an energy resolving unit to help initially mitigate the impact of the bullet.

Figure 33:
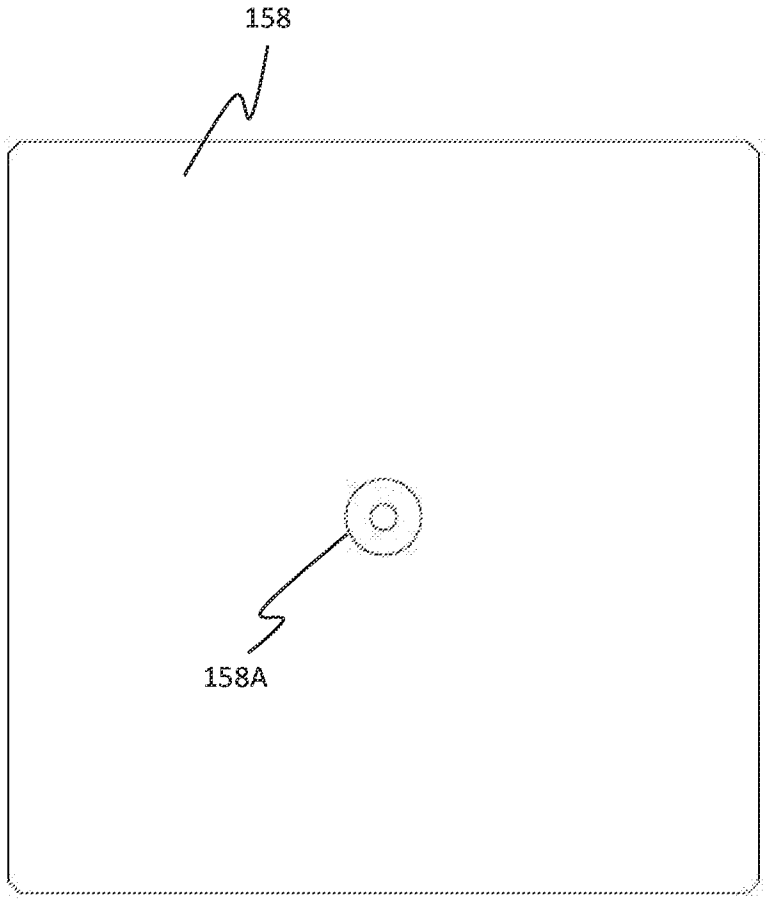
FIGS. 32 and 33 illustrate a bumper holder.
Figure 32:
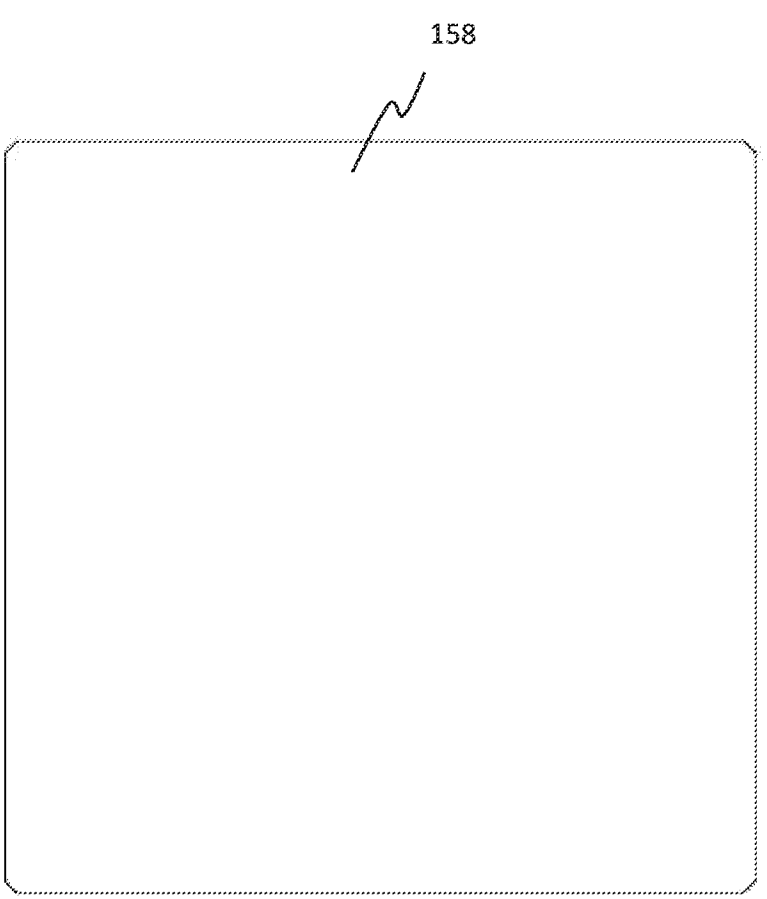

FIG. 32 shows the rear side of the bumper holder 158. FIG. 33 shows the front side of the bumper holder 158. FIG. 33 also shows the stability mechanism 158A.

Figure 34:
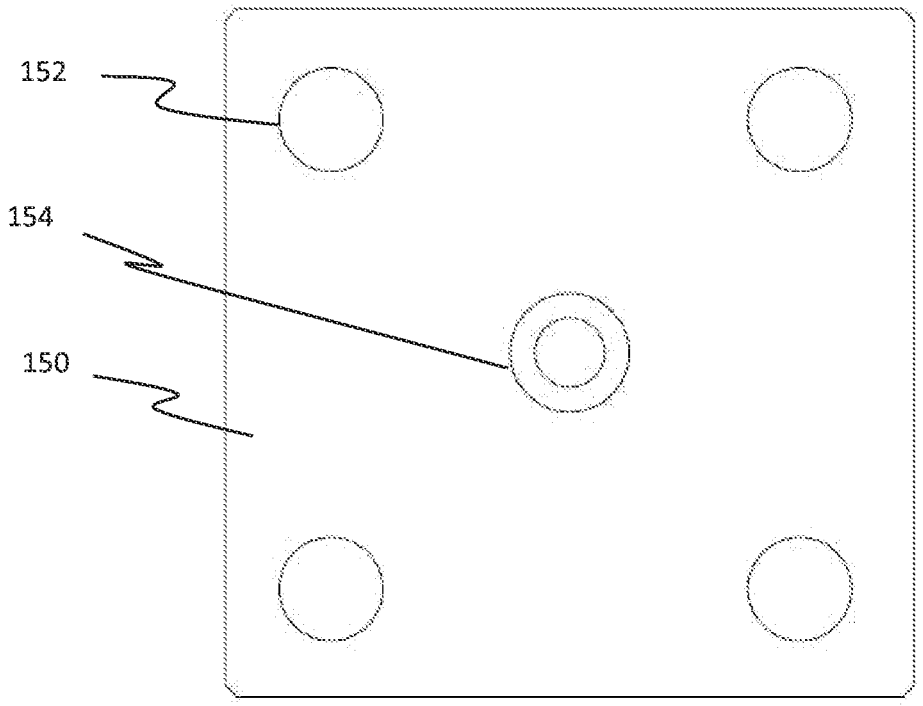
FIGS. 34 and 35 further illustrate the foam unit and springs.
Figure 35:
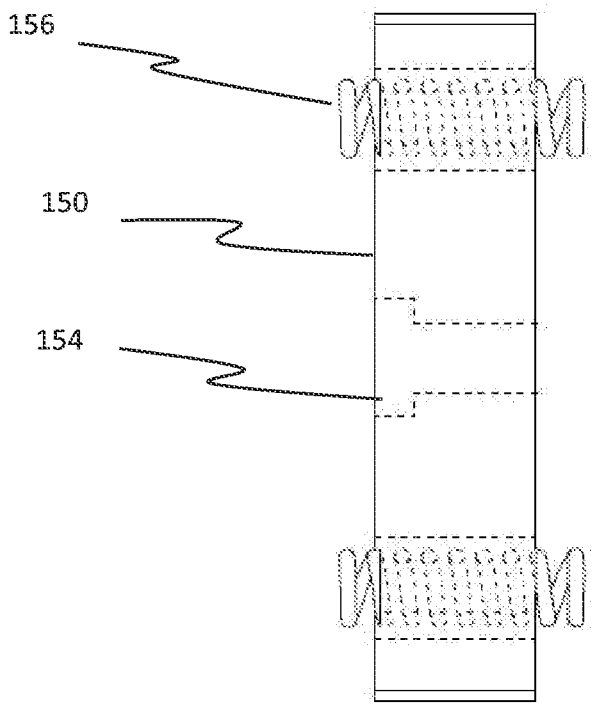

FIG. 34 again shows the foam unit 150, which includes various holes, including holes 152 and 154. FIG. 35 shows the foam unit 150, the hole 154, and the spring 156.

Figure 37:
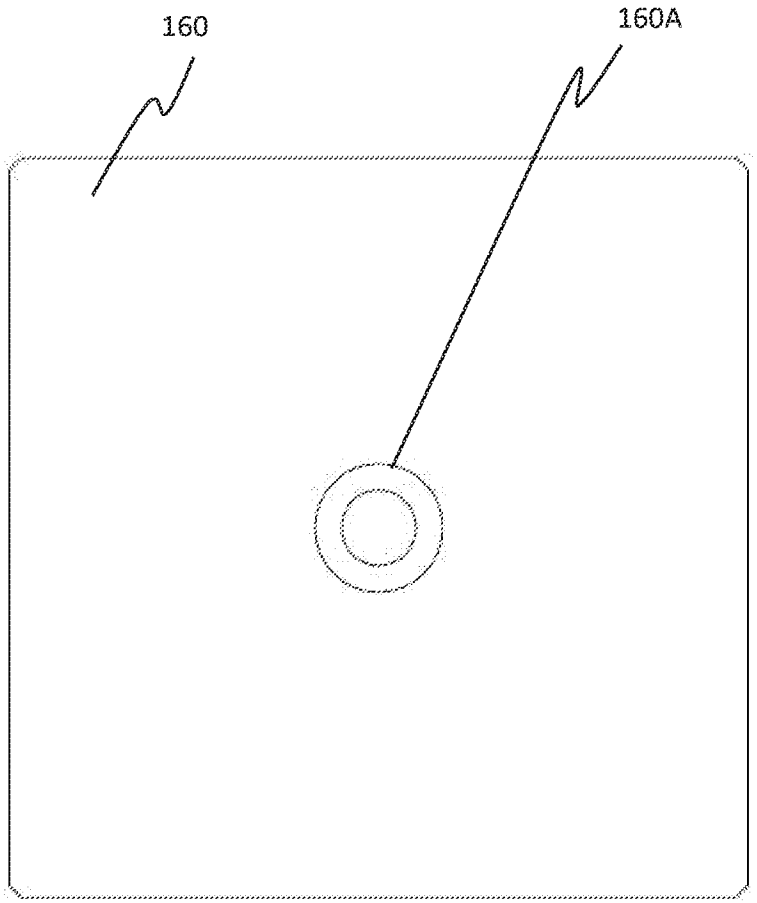
FIGS. 36 and 37 illustrate a bullet shield.
Figure 36:
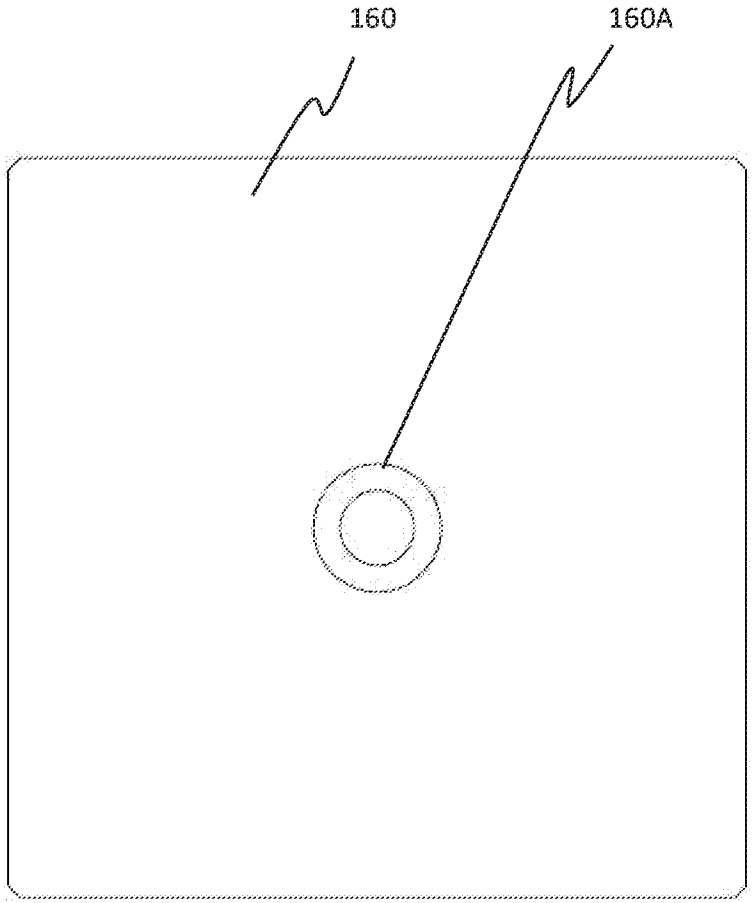

FIGS. 36 and 37 show the bullet shield 160 with the hole 160A. As mentioned, the dimensions of the bullet shield 160 can be about 4⅜ inches by 4⅜ inches. The size of the hole 160A (e.g., the inner circumference) can be about ½ inches. The outer circumference of the hole 160A can be about ¾ inches.

Figure 39:
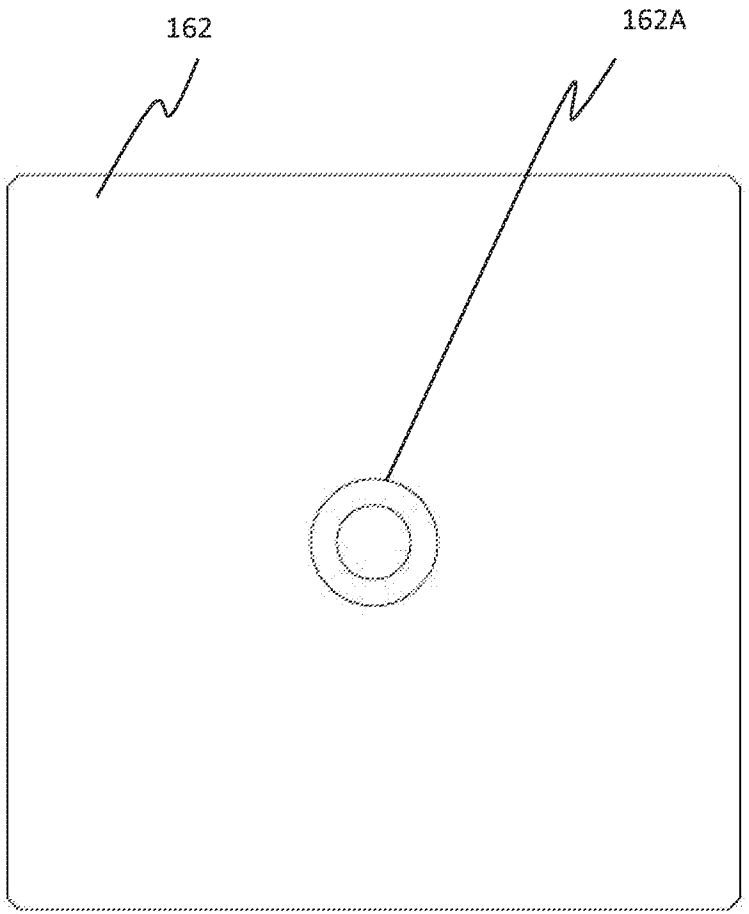
FIGS. 38 and 39 illustrate a plywood pad.
Figure 38:
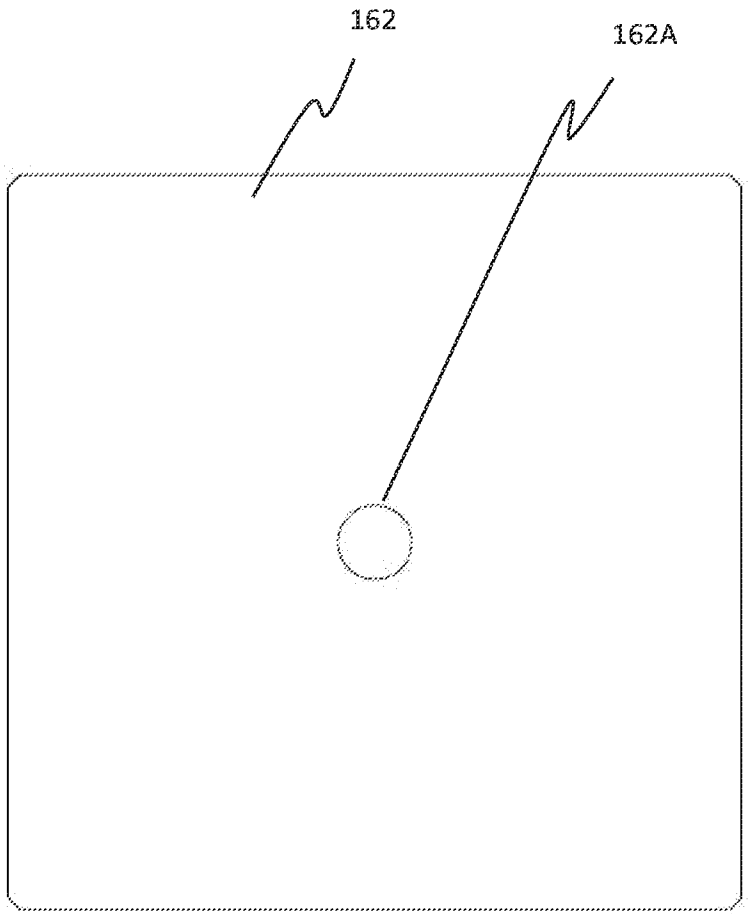

FIGS. 38 and 39 show the plywood pad 162 with the hole 162A. The inner circumference of the hole 162A is about ½ inches and the outer circumference of the hole 162A is about ¾ inches. Notice, FIG. 39 shows the outer circumference of the hole, which is the part through which the midsection of the bullet shield 160 can be inserted.

Figure 40:
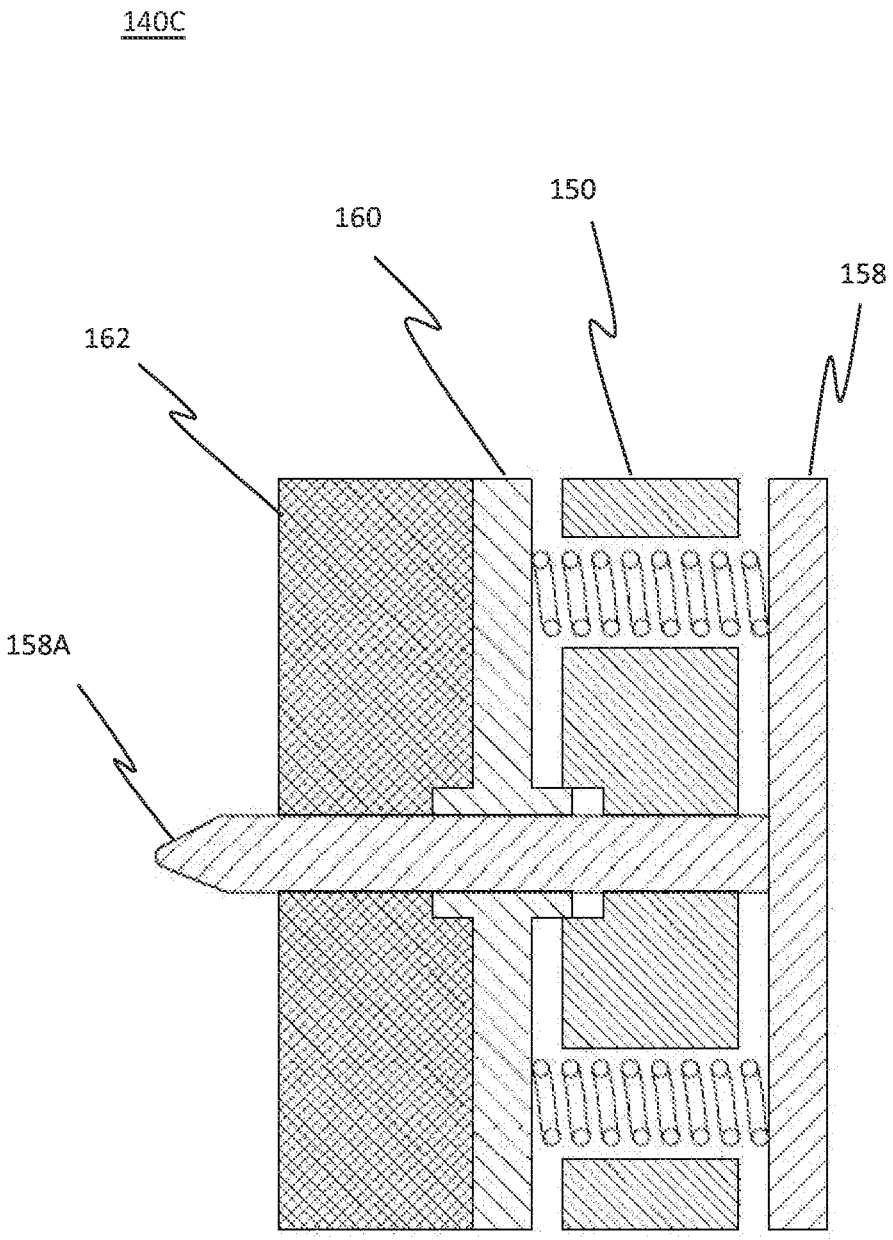
FIG. 40 illustrates the absorption unit.

FIG. 40 shows the entire absorption unit 140C. The absorption unit 140C includes the bumper holder 158, the stability mechanism 158A, the foam unit 150, the bullet shield 160, and the plywood pad 162. With regard to the absorption unit 140C, there can be anywhere from 1 to 4 springs included. The springs can be surrounded by foam, such as perhaps Styrofoam.

Accordingly, the disclosed embodiments relate to an apparatus structured to receive and contain a bullet in motion and to aid in determining a penetrative effect of the bullet relative to at least one material disposed within an internal confines of the apparatus. The apparatus can include an elongated central core comprising an internal cavity structured to house the material. The internal cavity is structured to facilitate ballistic penetrative testing on the material. In some embodiments, the elongated central core is shaped as a rectangular prism.

The apparatus includes a removable lid structured to couple to the elongated central core. When the removable lid is coupled to the elongated central core, a combination of the elongated central core and the removable lid cause the internal cavity to become a sealed internal cavity save for one directed entry section of the sealed internal cavity through which the bullet in motion can enter the internal cavity.

The apparatus further includes a funnel-like member having a wider opening and narrower opening. The funnel-like member is coupled to the elongated central core. The narrower opening provides the one directed entry section into the sealed internal cavity. The funnel-like member, based on its shape, is structured to guide the bullet into the sealed internal cavity. In some implementations, the funnel-like member is removable from the elongated central core. For instance, one or more bolts can be used to secure the funnel-like member to the elongated central core, and those bolts can optionally be removed.

The removable lid can include at least one handle. In some embodiments, the lid includes two handles. Having two handles enables an operator to more securely place and/or remove the lid. The removable lid can be coupled to the elongated central core via at least one of: a plurality of connecting bolts and/or a plurality of round wire lock pins. In some cases, both the bolts and the pins can be used to couple the lid to the elongated central core.

The elongated central core can optionally include at least two base supports on a bottom side of the elongated central core. The base supports help stabilize the positioning of the apparatus. Optionally, the base supports can be coupled to a framework so that the apparatus cannot be moved while bullets are being fired at the apparatus.

An absorption unit can be disposed in the internal cavity of the elongated central core. In some implementations, a plurality of springs are included as a part of the absorption unit. In some cases, foam is disposed around the springs. In some cases, a piece of wood (e.g., a plywood pad) is included as a part of the absorption unit. The absorption unit can further include a bumper holder and a bullet shield. The bumper holder comprises a stability mechanism, which can pass through holes of the foam unit, the bullet shield, and the plywood pad.

In some cases, the elongated central core is shaped as a rectangular prism. Optionally, the side walls of the rectangular prism can be lower in height as compared to heights of a front wall and back wall of the rectangular prism. For instance, FIG. 15 shows the side wall of the elongated central core 102; the side wall is shown as being lower in height as compared to the front and back portions or walls. In some implementations, the height of the side wall is anywhere from 75% to 95% the height of the front/back walls. In some implementations, a length of the lid is smaller than a length of the elongated central core. In some embodiments, the rear-facing section of the lid terminates about 2" from the rear section of the elongated central core. Thus, the elongated central core can include a top portion spanning about 2" from the rear section of the elongated central core.

Optionally, the elongated central core 102 is made of steel, and the removable lid 108 is also made of steel. As mentioned previously, other materials can be used. In some cases, multiple different materials can be used. For instance, the removable lid 108 can be made from a first material and the elongated central core 102 can be made from a second material.

The absorption unit, which is disposed inside of the internal cavity, can include a number of indents or recessed portions to accommodate a placement of the springs. That is, the terminal ends of the springs can fit within the recess portions of the absorption unit, and in particular in the holes of the foam unit. In some cases, the length of the springs, when not depressed, is around 1½". In some cases, the length is between about 1" and about 2". The thickness of the foam unit can correspond to the length of the springs.

Some embodiments include a method of using the disclosed apparatus. For instance, the method can include an act of positioning the apparatus at a secured position such that the apparatus will not move when a bullet is fired at the apparatus. An act can include disposing a material against an absorption unit that is disposed inside of the apparatus. This absorption unit includes piece of wood (e.g., the plywood pad). The material can be disposed against this plywood pad. The method can include securing the lid to the elongated central core. The method can include adding a target to the wider opening of the funnel-like member. The method can then include an act of firing a firearm at the target such that a bullet strikes the target and enters the internal cavity of the apparatus. The method can then include an act of removing the lid from the elongated central core. An act can include inspecting the material and analyzing the material to determine how it faired with regard to being struck by a bullet. Optionally, multiple materials can be disposed in the internal cavity. Optionally, the method can be repeated any number of times for any number of materials.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus structured to receive and contain a bullet in motion and to aid in determining a penetrative effect of the bullet relative to at least one material disposed within an internal confines of the apparatus, said apparatus comprising:

an elongated central core comprising an internal cavity structured to house the at least one material, the internal cavity structured to facilitate ballistic penetrative testing on the at least one material, wherein the elongated central core is shaped as a rectangular prism, and wherein side walls of the rectangular prism are lower in height as compared to heights of a front wall and a back wall of the rectangular prism;

a removable lid structured to couple to the elongated central core, wherein, when the removable lid is coupled to the elongated central core, a combination of the elongated central core and the removable lid cause the internal cavity to become a sealed internal cavity save for one directed entry section of the sealed internal cavity through which the bullet in motion can enter the internal cavity;

a funnel-like member having a wider opening and narrower opening, wherein the funnel-like member is coupled to the elongated central core, wherein the narrower opening provides the one directed entry section into the sealed internal cavity, and wherein the funnel-like member, based on its shape, is structured to guide the bullet into the sealed internal cavity; and an absorption unit structured to absorb an impact of the bullet.

2. The apparatus of claim 1, wherein the funnel-like member is removable from the elongated central core.

3. The apparatus of claim 1, wherein the removable lid includes at least one handle.

4. The apparatus of claim 1, wherein the removable lid is coupled to the elongated central core via at least one of: a plurality of connecting bolts or a plurality of round wire lock pins.

5. The apparatus of claim 1, wherein the elongated central core includes at least two base supports on a bottom side of the elongated central core.

6. The apparatus of claim 1, wherein the absorption unit is disposed in the internal cavity of the elongated central core, and wherein a plurality of springs are disposed as a part of the absorption unit.

7. The apparatus of claim 1, wherein a size of the wider opening of the funnel-like member is at least 4 inches.

8. The apparatus of claim 1, wherein a size of the wider opening of the funnel-like member is within a range spanning between 4 inches and 8 inches.

9. An apparatus structured to receive and contain a bullet in motion and to aid in determining a penetrative effect of the bullet relative to at least one material disposed within an internal confines of the apparatus, said apparatus comprising:

an elongated central core comprising an internal cavity structured to house the at least one material, the internal cavity structured to facilitate ballistic penetrative testing on the at least one material, wherein the elongated central core is shaped as a rectangular prism;

a removable lid structured to couple to the elongated central core, wherein, when the removable lid is coupled to the elongated central core, a combination of the elongated central core and the removable lid cause the internal cavity to become a sealed internal cavity save for one directed entry section of the sealed internal cavity through which the bullet in motion can enter the internal cavity, and wherein the removable lid includes a top section, a first side section, and a second side section, the first side section and the second side section both being oriented orthogonally relative to the top section;

a funnel-like member having a wider opening and narrower opening, wherein the funnel-like member is coupled to the elongated central core, wherein the narrower opening provides the one directed entry section into the sealed internal cavity, and wherein the funnel-like member, based on its shape, is structured to guide the bullet into the sealed internal cavity; and an absorption unit.

10. The apparatus of claim 9, wherein the elongated central core is made of steel, and wherein the removable lid is made of steel.

11. The apparatus of claim 9, wherein a target is disposed in the wider opening of the funnel-like member.

12. The apparatus of claim 9, wherein the removable lid includes a first handle and a second handle.

13. The apparatus of claim 12, wherein a first hinge couples the first handle to the removable lid, and wherein a second hinge couples the second handle to the removable lid.

14. The apparatus of claim 9, wherein the removable lid includes a drop-down member that is orthogonal to a base of the lid, wherein, when the removable lid is coupled to the elongated central core, the drop-down member covers a protruding member affixed to the elongated central core, and wherein a connection member passes through both the drop-down member and the protruding member to seal the removable lid to the elongated central core.

15. The apparatus of claim 9, wherein the removable lid includes a first handle and a second handle, wherein the removable lid includes a first terminal end and a second terminal end, and wherein the first handle is closer to the first terminal end than the second handle is to the second terminal end.

16. The apparatus of claim 9, wherein a size of the narrower opening is about ⅓ a size of the wider opening.

17. An apparatus structured to receive and contain a bullet in motion and to aid in determining a penetrative effect of the bullet relative to at least one material disposed within an internal confines of the apparatus, said apparatus comprising:

an elongated central core comprising an internal cavity structured to house the at least one material, the internal cavity structured to facilitate ballistic penetrative testing on the at least one material;

a removable lid structured to couple to the elongated central core, wherein:

when the removable lid is coupled to the elongated central core, a combination of the elongated central core and the removable lid cause the internal cavity to become a sealed internal cavity save for one directed entry section of the sealed internal cavity through which the bullet in motion can enter the internal cavity, the removable lid includes a first handle, and the removable lid includes a second handle;

a funnel-like member having a wider opening and narrower opening, wherein the funnel-like member is coupled to the elongated central core, wherein the narrower opening provides the one directed entry section into the sealed internal cavity, and wherein the funnel-like member, based on its shape, is structured to guide the bullet into the sealed internal cavity; and an absorption unit structured to absorb an impact of the bullet, wherein a stabilizing mechanism is provided as a part of the absorption unit.

18. The apparatus of claim 17, wherein the stabilizing mechanism passes through a hole of a foam unit, a hole of a bullet shield, and a hole of a plywood unit.

19. The apparatus of claim 18, wherein springs are disposed within corresponding holes of the foam unit.

20. The apparatus of claim 17, wherein a height of the interval cavity is at least 4 inches.

* * * * *